US005938192A

United States Patent [19]

Kosasa

[11] Patent Number: 5,938,192

[45] **Date of Patent: *Aug. 17, 1999**

[54] SHEET ACCOMMODATING APPARATUS AND SHEET BINDING APPARATUS

[75] Inventor: Hideaki Kosasa, Kashiwa, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/899,636

[22] Filed: Jul. 24, 1997

[30] Foreign Application Priority Data

Jul. 25, 1996 [JP] Japan ..... 8-196672
Jan. 14, 1997 [JP] Japan ..... 9-005099

[51] Int. Cl.[6] ..... B65H 31/38

[52] U.S. Cl. ..... 271/221; 271/176; 271/265.03; 271/223; 271/3.02; 270/56; 270/58.09; 270/58.31

[58] Field of Search ..... 271/265.01, 265.02, 271/221, 223, 176, 220, 265.03, 3.02; 270/56, 58.09, 58.12, 58.04; 399/393, 395, 389, 405, 407

[56] References Cited

U.S. PATENT DOCUMENTS

| | | | |
|---|---|---|---|
| 4,934,683 | 6/1990 | Ueda et al. | 271/176 |
| 5,013,021 | 5/1991 | Johdai et al. | 271/221 X |
| 5,037,083 | 8/1991 | Johdai et al. | 271/288 |
| 5,072,920 | 12/1991 | Kubota et al. | 271/221 X |
| 5,181,705 | 1/1993 | Ueda et al. | 271/176 X |
| 5,382,016 | 1/1995 | Kobayashi et al. | 271/221 X |
| 5,524,873 | 6/1996 | Hosoi et al. | 271/221 X |
| 5,575,469 | 11/1996 | Coombs et al. | 271/270 |
| 5,590,871 | 1/1997 | Okabe et al. | 271/221 X |
| 5,634,634 | 6/1997 | Dobbertin et al. | 271/221 X |
| 5,657,977 | 8/1997 | Kato et al. | 271/221 X |
| 5,722,650 | 3/1998 | Yamamoto et al. | 271/221 X |

FOREIGN PATENT DOCUMENTS

| | | |
|---|---|---|
| 360178143 | 9/1985 | Japan . |
| 401075356 | 3/1989 | Japan . |
| 404140270 | 5/1992 | Japan . |
| 408067357 | 3/1996 | Japan . |

*Primary Examiner*—H. Grant Skaggs
*Assistant Examiner*—Patrick Mackey
*Attorney, Agent, or Firm*—Fitzpatrick, Cella, Harper & Scinto

[57] ABSTRACT

A sheet accommodating apparatus includes sheet accommodating means for accommodating one by one sheets fed thereto; aligning means for aligning the sheets; sheet interval detecting means for detecting interval time or distance between adjacent sheets; and control means for preventing the aligning means from operating when an output of the sheet interval detecting means indicates that sheet interval time or distance is shorter than time required for the aligning means to align the sheets or the distance through which the sheets moves in the time required for the aligning means to align the sheets.

17 Claims, 24 Drawing Sheets

SHEET ACCOMMODATING APPARATUS AND SHEET BINDING APPARATUS

FIELD OF THE INVENTION AND RELATED ART

The present invention relates to a sheet storing apparatus which comprises sheet aligning means, and aligns sheets as it stores them. More specifically, it relates to a sheet storing apparatus usable with a sheet processing apparatus which binds printed sheets, or a sheet storing apparatus usable with an image forming apparatus.

Prior to the present invention, in a sheet storing apparatus used with an image forming apparatus or a sheet processing apparatus, the sheets delivered into the storing means of a sheet storing apparatus one by one is aligned by an aligning means during a sheet delivery (interval an interval between a sheet having been delivered and the following sheet to be delivered). This type of sheet storing apparatus is controlled in such a manner that as a sheet being delivered into the sheet storing apparatus is detected by an aligning timing sensor, the aligning means is moved from the standby position to the aligning position, which is a predetermined distance away from the standby position, after a predetermined delay (after the sheet completely settles on the storing tray), to align the delivered sheet, and then, is moved back from the aligning position to the standby position.

In the case of a certain type of sheet storing apparatus, an inserting apparatus is connected to the upstream side thereof, so that an insert sheet, which constitutes an identification sheet or a cover sheet, can be inserted between adjacent two sets of sheets delivered into the sheet storing apparatus from, for example, an image forming apparatus.

However, the distance between the preceding sheet and the following sheet sometimes becomes shorter than a predetermined distance, because the speed of a plurality of the conveyer rollers, or the like, of an apparatus for conveying sheets to a sheet storing, fluctuates sometime, or slipping occurs between the conveyer rollers and a sheet. This shorter distance between adjacent two sheets (inter-sheet distance or sheet interval) creates a situation that there is not enough time the aligning means to properly align the sheets. One way to prevent the occurrence of such a situation is to slow down the sheet conveying speed of an apparatus, for example, an image forming apparatus, which delivers the sheet into the sheet storing apparatus, so that sheet interval is increased. However, increasing the sheet interval creates a problem that image formation productivity drops.

Further, when an insert sheet is inserted between adjacent two sheets by an inserting apparatus as sheets are delivered from, for example, an image forming apparatus, the productivity of an apparatus which delivers sheets into the sheet storing means must be further reduced to expand the sheet interval, or the speed at which sheets are delivered to the sheet storing apparatus must be increased in anticipation of the sheet insertion by the inserting apparatus, so that the time, that is, the sheet interval, necessary for proper sheet alignment can be afforded. This is due to the fact that it is rather difficult to control a sheet storing apparatus so that the sheet interval is properly maintained in spite of the insertion of an insert sheet for every predetermined number of sheets.

As a result, the productivity of the apparatus which delivers sheets to the storing means drops. Also, in order to increase the sheet conveying speed and sheet aligning speed, it is necessary to increase the speed and torque of the driving motors, which leads to cost increase.

SUMMARY OF THE INVENTION

The primary object of the present invention is to provide a sheet storing apparatus capable of properly aligning sheets without reducing the productivity of an apparatus from which sheets are delivered.

According to an aspect of the present invention, a sheet storing apparatus comprising storing means which stores incoming sheets by accumulating the sheets one by one, an aligning means for aligning the incoming sheets, further comprises: a sheet interval detecting means which detects sheet interval in terms of time or distance, and a controlling means which controls the sheet storing apparatus so that when the sheet interval detected by the sheet interval detecting means is less in terms of time or distance than the time or distance, respectively, necessary for the aligning means to align the incoming sheets, the aligning means is not activated.

According to another aspect of the present invention, the sheet interval detecting means is an optical sensor which doubles as a jam sensor which detects a paper jam caused by the sheets conveyed into the storing means.

According to another aspect of the present invention, a sheet storing apparatus comprising: a storing means which stores in coming sheets by accumulating one by one; an aligning means which aligns the incoming sheets at the lateral edge parallel to the direction in which the sheets are conveyed into the storing means; and an inserting apparatus capable of inserting an insert sheet between the preceding set of sheets and the following set of sheets, further comprises: an insert sheet detecting means which detects the insert sheet delivered from the inserting apparatus; and controlling means which controls the sheet storing apparatus so that when the insert sheet detected by the insert sheet detecting means, and the sheet immediately preceding the detected insert sheet, are stored in the storing means, the aligning means is not activated.

Further, as soon as the sheet interval detected by the sheet detecting means recovers to a predetermined length or greater, the aligning means is reactivated.

According to another aspect of the present invention, a sheet refeeding apparatus comprising: a storing means which stores incoming sheets by accumulating the sheets one by one; an aligning means which aligns the incoming sheets; and refeeding means which feeds an apparatus, for example, an image forming apparatus, with the sheets stored in the storing means, further comprises: a sheet interval detecting means which detects the sheet interval in terms of time or distance, and a controlling means which controls the sheet storing means so that when the sheet interval detected by the sheet interval detecting means is less in terms of time or distance than the time or distance, respectively, necessary for the aligning means to properly align the incoming sheets, the aligning means is not activated.

According to another aspect of the present invention, a sheet sorting apparatus comprising a plurality of storing means which sorts and stores the sheets discharged from discharging means, and an aligning means which aligns the sheets, further comprises: a sheet interval detecting means which detects sheet interval in terms of time or distance, and a controlling means which controls the sheet storing means so that when the sheet interval detected by the sheet interval detecting means is less in terms of time or distance than the time or distance, respectively, necessary for the aligning means to properly align the incoming sheets, the aligning means is not activated.

With the provision of the above described structures, as sheets are conveyed into the storing means, their intervals are detected by the sheet interval detecting means, and are aligned by the aligning means which is controlled in response to the detected sheet intervals.

More specifically, the sheet storing means is controlled by the controlling means so that when the sheet interval detected by the sheet interval detecting means is less in terms of time or distance than the time or distance, respectively, necessary for the aligning means to properly align the sheets, the aligning means is not activated.

Therefore, it is unnecessary to reduce the sheet conveyance speed of an apparatus, for example, an image forming apparatus, which delivers sheets to the sheet storing means. In other words, it is unnecessary to reduce productivity to properly align and store sheets in a sheet storing apparatus.

Further, the sheet storing apparatus is controlled so that when it is detected by the insert sheet detecting means that an insert sheet is inserted by an inserting apparatus, between the sheets conveyed into the storing means, the aligning means is not activated while the insert sheet detected by the insert sheet detecting means, and the sheet immediately preceding the detected insert sheet, are stored in the storing means.

Therefore, the speed at which sheets are conveyed into a sheet storing apparatus does not need to be increased to secure the sheet interval, in terms of time or distance, necessary for proper sheet alignment, in anticipation of the insertion of an insert sheet from an inserting apparatus.

According to the present invention, storing means is controlled so that the aligning means is not activated when it is detected by the sheet interval detecting means that the sheet interval with which sheets are conveyed into the storing means is less in terms of time or distance than the time or distance, respectively, necessary for the sheet aligning means to align a sheet. Therefore, sheets can be desirably stored without reducing the sheet conveyance speed of an apparatus, such as an image forming apparatus, from which sheets are delivered to the storing means; in other words, sheets can be desirably stored without reducing productivity.

Further, an optical sensor as a jam detection sensor which detects paper jam caused by incoming sheets is used as a sheet interval detecting means, and interval, in terms of time or distance, of the sheets being conveyed into a sheet storing apparatus is detected by this optical sensor, eliminating the need for an additional sensor. Therefore, cost increase is suppressed.

Further, when an insert sheet is inserted between sheets by an inserting apparatus connected to a storing means, on the upstream side, a sheet storing apparatus is controlled so that the aligning means is not activated for the insert sheet from the inserting apparatus, and the sheet immediately preceding the insert sheet. Therefore, it is unnecessary to increase sheet interval even when an insert sheet is inserted by an inserting apparatus, between sheets delivered from an image forming apparatus.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

EMBODIMENT 1

Next, the first embodiment of the present invention will be described.

Figure 1:
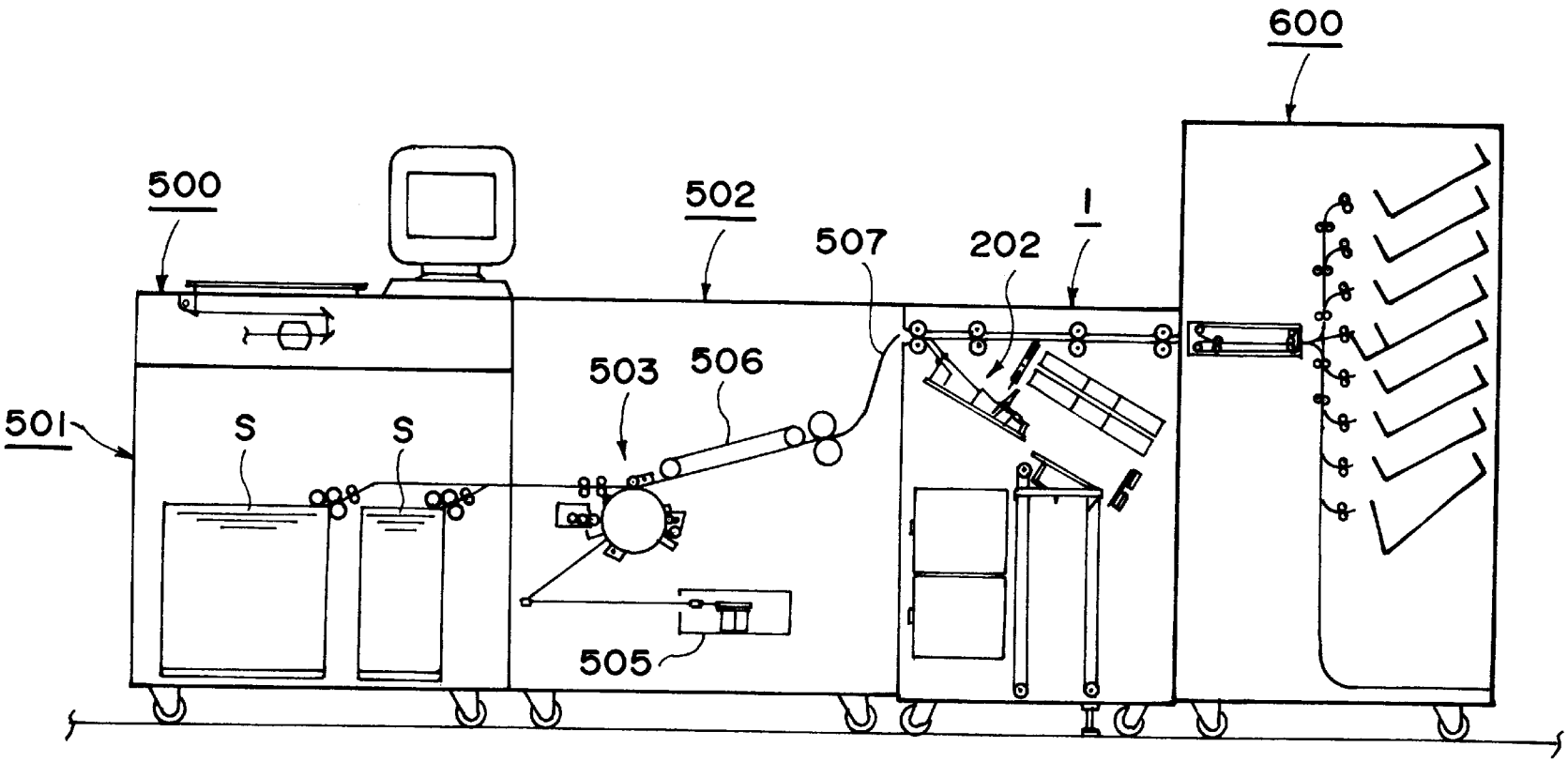
FIG. 1 is a vertical, longitudinal section of an on-line sheet processing apparatus, to which a binding apparatus comprising the sheet storing apparatus in the first embodiment of the present invention is connected.

FIG. 1 illustrates an on-line sheet processing apparatus provided with a binding apparatus comprising a sheet storing apparatus in accordance with the present invention, and an image forming apparatus to which the on-line sheet processing apparatus is connected.

The system illustrated in FIG. 1 comprises an image reading apparatus 500, a sheet feeding apparatus 501, an image forming apparatus 502, and an on-line sheet processing apparatus provided with a binding apparatus 1, and a sorting-storing apparatus 600.

The image data read by the image reading apparatus 500 are sent to the scanning apparatus 505 of the image forming apparatus 502 to form an image in an image forming portion 503 inclusive of a photosensitive drum. Meanwhile, a sheet S is delivered to the image forming portion 503, in which an image formed in the image forming portion 503 is transferred onto the sheet S. Thereafter, the sheet S with the transferred image is conveyed to the sorting apparatus 600, through a sheet conveying path 507 and the binding apparatus 1, being formed into a book and then sorted, or simply sorted.

Figure 2:
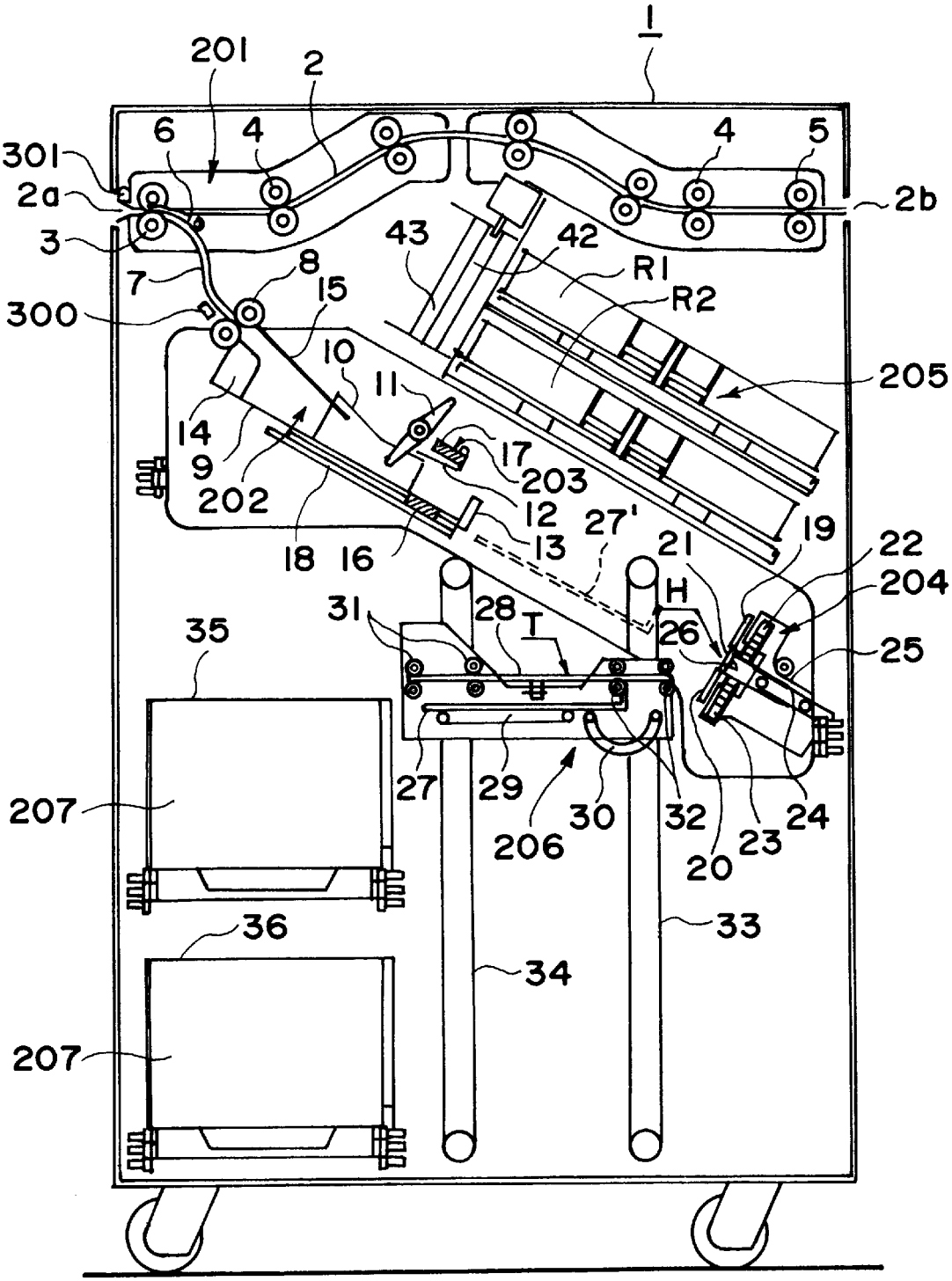
FIG. 2 is a vertical section of the binding apparatus comprising the sheet storing apparatus in accordance with the present invention.

Referring to FIG. 2, the binding apparatus 1 comprises a sheet conveying apparatus 201, a sheet storing apparatus 202, a sheet set conveying apparatus 203, a tape heating apparatus (binding means) 204, a tape conveying apparatus 205, a bound sheet set conveying apparatus 206, and a stacking type storage 207.

The sheet conveying apparatus 201 has a sheet conveying path 2 through which the sheet S is conveyed. The sheet conveying path 2 has an entrance 2*a* and an exit 2*b*, and is equipped with a entrance roller pair 3, a plurality of conveyer roller pairs 4, a discharge roller pair 5. They are disposed in this order from the upstream side along the sheet conveying path 2. There is disposed a flapper 6 as directing means adjacent to the entrance roller pair 3 and on the downstream side, to connect the sheet conveying path to a sheet conveying path 7 when the sheet S is to be bound.

The sheet S directed into the sheet conveying path 7 by the flapper 6 is delivered to the sheet storing apparatus 202 by the sheet conveying roller pair 8.

Figure 3:
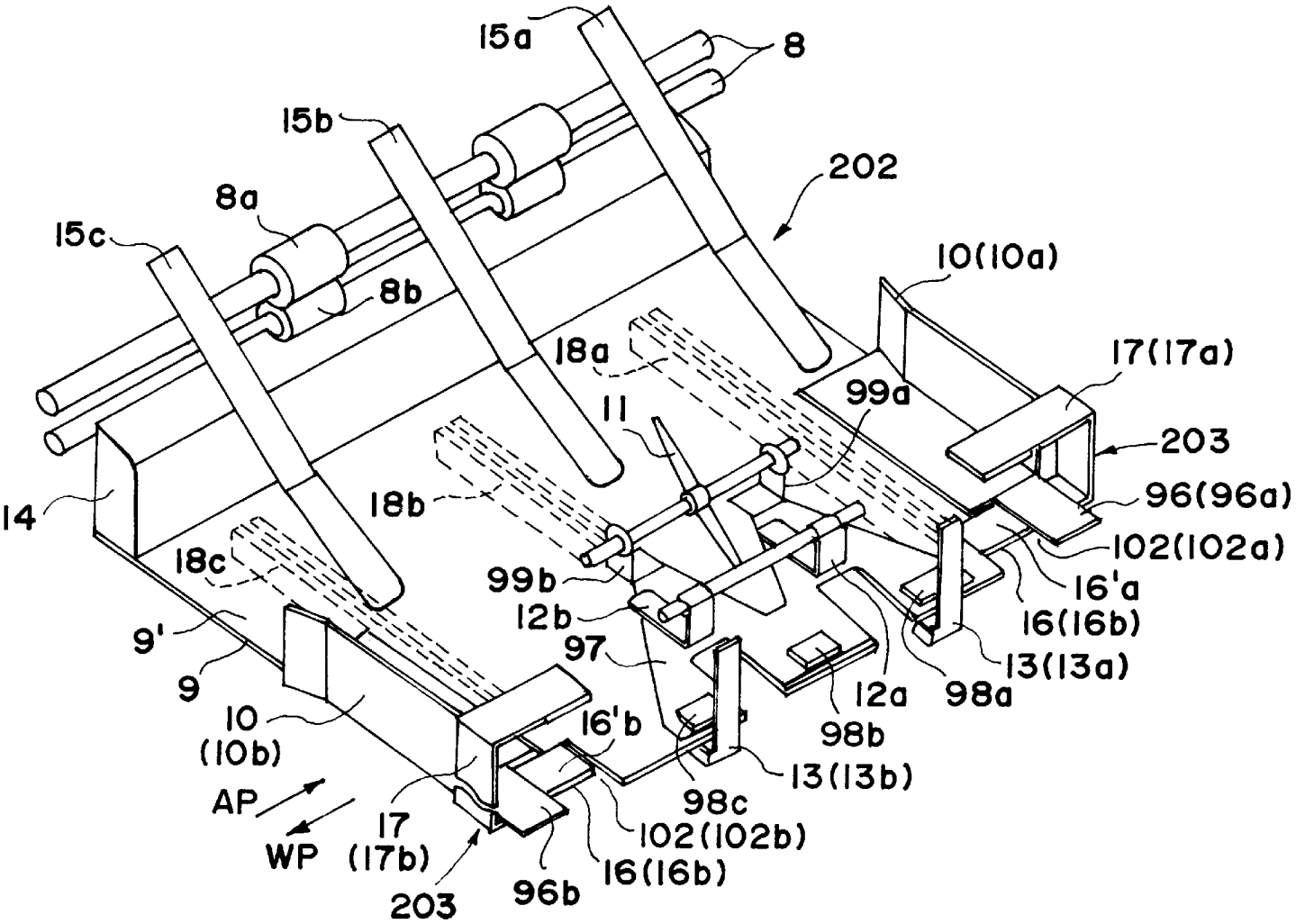
FIG. 3 is a perspective view of the sheet storing apparatus illustrated in FIG. 2.

FIG. 3 is a perspective view of the sheet storing apparatus 202. Next, the structure of the sheet storing apparatus 202 will be described.

In the drawing, a reference numeral 9 designates a storage tray (storing means) which stores sheets; 9 the storage tray surface on which sheets are accumulated (sheet accumulating surface); 10, an aligning fence (aligning means), a portion of which is parallel to the direction in which sheets are conveyed; 11, an aligning paddle for aligning the leading edge of the sheet, which is pivotable in response to the combined thickness of the sheets accumulated in the storage tray, in the direction vertical to the top surface of the accumulated sheets; 12, a stop finger which temporarily holds the sheet S during the interval which follows each binding action; 13, a leading edge reference shutter (edge aligning means) as an aligning sheet stopper against which the leading edge of the sheet is bumped; 14, a bottom side entrance guide which guides the bottom surface of the sheet at the entrance of the sheet storing apparatus 202; and a reference numeral 15 designates a top surface side entrance guide which guides the top surface of the sheet S at the entrance of the sheet storing apparatus 202.

Figure 4A:
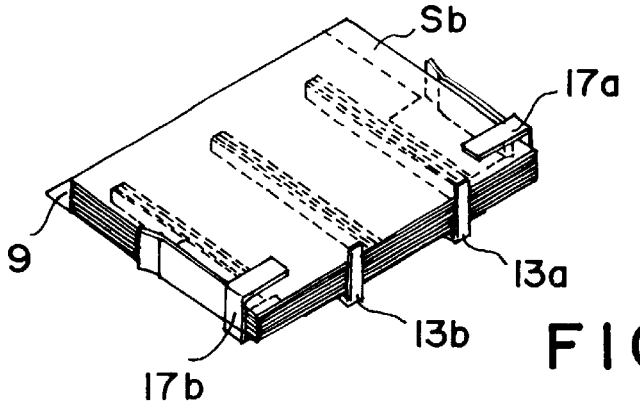
FIGS. 4(*a*), 4(*b*), and 4(*c*) are perspective views of the sheet storing apparatus, depicting various stages in the conveyance of a sheet set delivered into a storage tray.
Figure 4B:
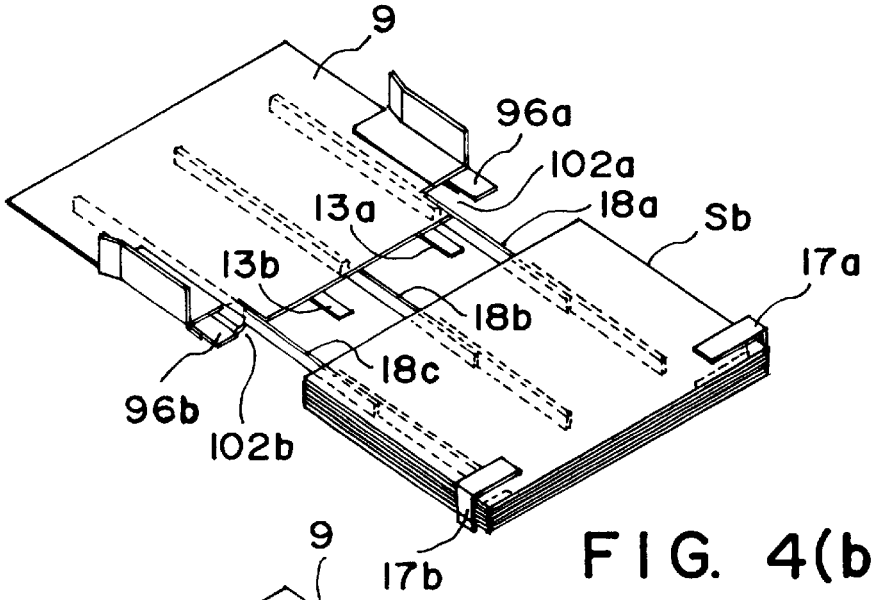
Figure 4C:
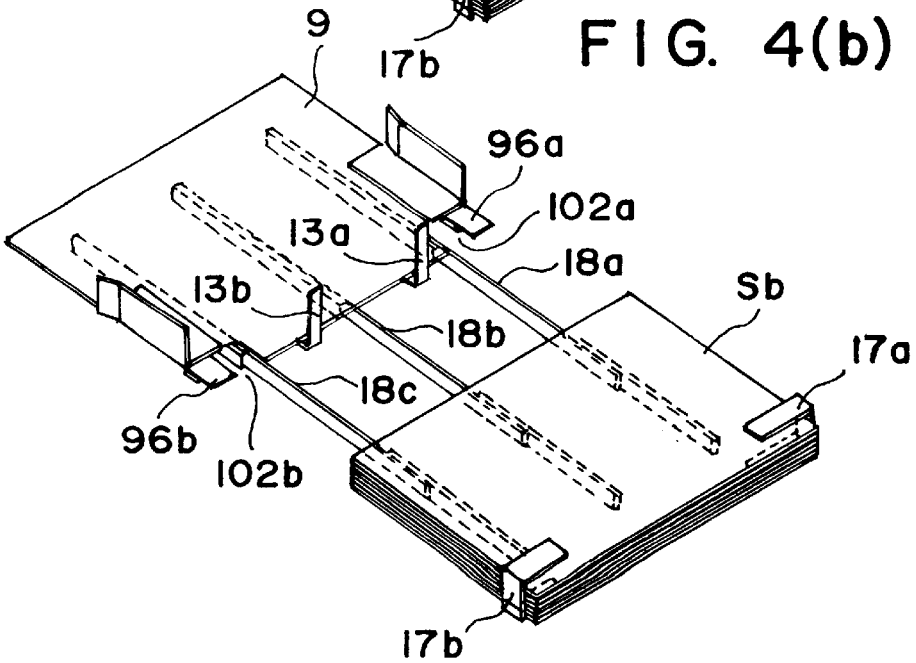

A reference numeral 203 designates the sheet set conveying apparatus, which comprises: a stationary gripping plate 16 (16*a*, 16*b*), the top surface of which is even with the sheet accumulating surface 9'; a movable gripping plate 17 (17*a*, 17*b*) vertically movable relative to the stationary gripping plate 16; a driving mechanism (unillustrated) which drives the movable gripping plate 17; a mechanism (unillustrated) which shifts the movable gripping plate 17 and the stationary gripping plate 16; a sheet set guide 18*a*, 18*b*, and 18*c* (FIGS. 4(*a*), 4(*b*) and 4(*c*); and the like.

A reference numeral 96 designates a sheet bottom regulating member, which is formed of a piece of thin plate. It regulates the bottom surface of the sheet delivered into the sheet set conveying apparatus 203. More specifically, as the sheet S is delivered into the sheet set conveying apparatus 203, the sheet bottom regulating member 96 supports the sheet S by the lateral edge parallel to the sheet conveyance direction, in the adjacencies of a point at which a set of aligned sheets are gripped by the sheet set conveying apparatus 203 (hereinafter, sheet set gripping point) so that the sheet edge remains at the same level as the sheet accumulating surface 9' of the storage tray 9; in other words, the sheet edge does not droop below the sheet gripping surface 16' (16'*a*, and 16'*b*) of the stationary gripping plate 16 (16*a*, 16*b*).

A reference numeral 97 designates a leading edge top regulating member which is connected to the supporting member of the aligning paddle 11 to regulate the sheet S from the top surface side as the sheet S moves into the adjacencies of the sheet set gripping point of the sheet set conveying apparatus 203. It begins regulating the sheet S as the leading edge of the sheet S approaches the leading edge reference shutter 13. A reference numeral 98 (98*a*, 98*b*, and 98*c*) designates a weight which applies a predetermined pressure to the sheet S by way of the leading edge top regulating member 97. A reference numeral 99 designates a fixing member for attaching the leading edge top regulating member 97 to the supporting member of the aligning paddle 11. A reference numeral 102 designates a cutout portion of the storage tray 9, which constitutes a passage through which the stationary gripping plate 16 (16*a*, 16*b*) of the sheet set conveying apparatus 203 is shifted to the gripping position.

As the sheet S is introduced into the sheet storing apparatus 202 structured as described above, the top and bottom surfaces of the sheet S are guided by the top surface side entrance guide 15 (15*a*, 15*b*, and 15*c*) and the bottom surface side entrance guide 14, respectively, and then, the sheet S bumps against the leading edge reference shutter 13 (13*a*, 13*b*).

During this conveyance of the sheet S, the sheet S is held down by the aligning paddle 11, and is aligned at the leading edge by the leading edge reference shutter 13, and also is aligned by the aligning fence 10 in the direction perpendicular to the sheet conveyance direction. In other words, the sheet S is aligned on the storage tray 9 in both the sheet conveyance direction and the direction perpendicular thereto.

The sheet bottom regulating member 96 formed of a piece of thin plate regulates the sheet S on the storage tray 9 from the bottom side so that the sheet edge parallel to the sheet conveyance direction is prevented from drooping below the sheet gripping surface 16' (16'*a*, 16'*b*) of the stationary gripping plate 16 as the sheet S is conveyed into the adjacencies of the sheet set gripping point of the sheet set conveying apparatus 203.

Between the leading edge reference shutter 13 and the sheet gripping point of the sheet conveying apparatus 203, the sheet S is regulated from above, by the leading edge top regulating member 97 connected to the supporting member of the aligning paddle 11 with the use of the fixing member 99, and the weight 88 which applies predetermined pressure.

The aligning fence 10 is constituted of a fixed fence 10*a* or a movable fence 10*b*, and the sheet S is aligned using the fixed fence 10*a* as a reference. When a plurality of sheet sets are continuously bound, the stop finger 12 (12*a*, 12*b*) is activated, temporarily holding each sheet set while the preceding sheet set is bound, and then is deactivated to release the temporarily held sheet set after the preceding sheet set is conveyed out of the storage tray 9.

As soon as all the sheets in each set are aligned in the sheet storing apparatus 202, the mechanism for driving the movable gripping plate 17 is activated. At this time, the sheet gripping plate 17 is located at the sheet gripping position (FIG. 3). Then, the movable gripping plate 17 grips a sheet set in coordination with the stationary gripping plate 16 which supports the sheet set from underneath (FIG. 4(*a*)). Upon completion of the gripping of the sheet set, the mechanism for shifting the movable gripping plate 17 and the stationary gripping plate 16 is activated to shift the gripping plates 17 and 16 from the sheet storing apparatus 202 to the tape heating apparatus 204, so that the sheet set, that is, a set of aligned sheets, is conveyed from the sheet storing apparatus 202 to the tape heating apparatus 204 (FIG. 4(*b*)).

At this time, the bottom side of the trailing end of the sheet set is supportively guided by a sheet set guide 18 (18*a*, 18*b*, and 18*c*) which moves with the movable gripping plate 17 and the stationary gripping plate 16.

Referring to FIG. 2, the tape heating apparatus 204 comprises tape guides 19 and 20, a central heater 21, side heaters 22 and 23, the driving mechanism 24 for the central heater 21, the driving mechanism 25 for the side heaters 22 and 23, and the like.

To the tape heating apparatus 204, a binder tape 26 is supplied by the tape guides 19 an 20 (FIGS. 2 and 7) of the tape conveying apparatus 205 before the set of aligned sheets are delivered to the tap heating apparatus 204 by the sheet set conveying apparatus 203.

Figure 7:
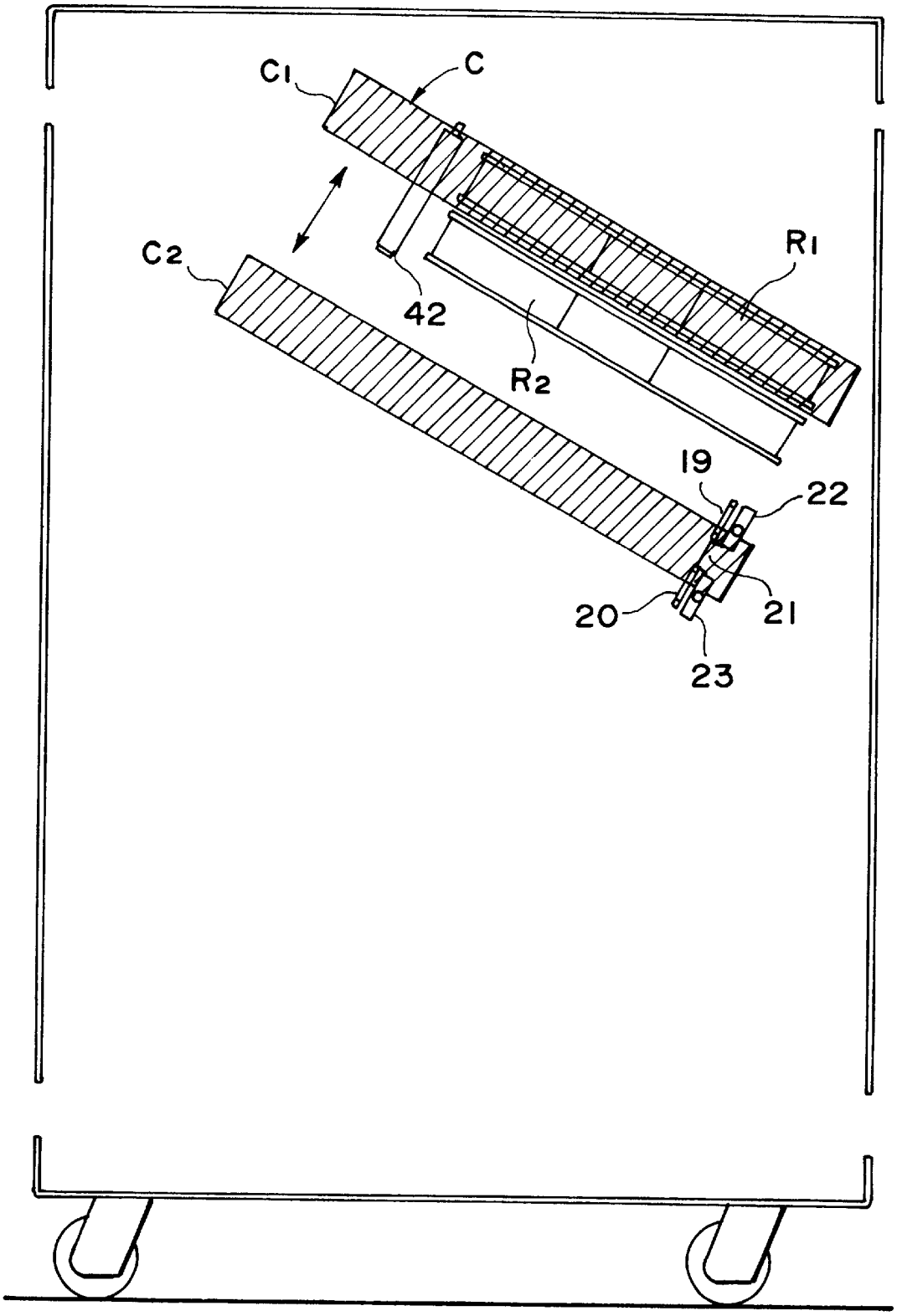
FIG. 7 is a front view of the carriage of the tape conveying apparatus illustrated in FIG. 6.

The tape conveying apparatus 205 comprises tape reels R1 and R2, a carriage C, a tape cutter 42, tape conveying means 43 and 44, and the like (FIGS. 2 and 7).

Figure 6:
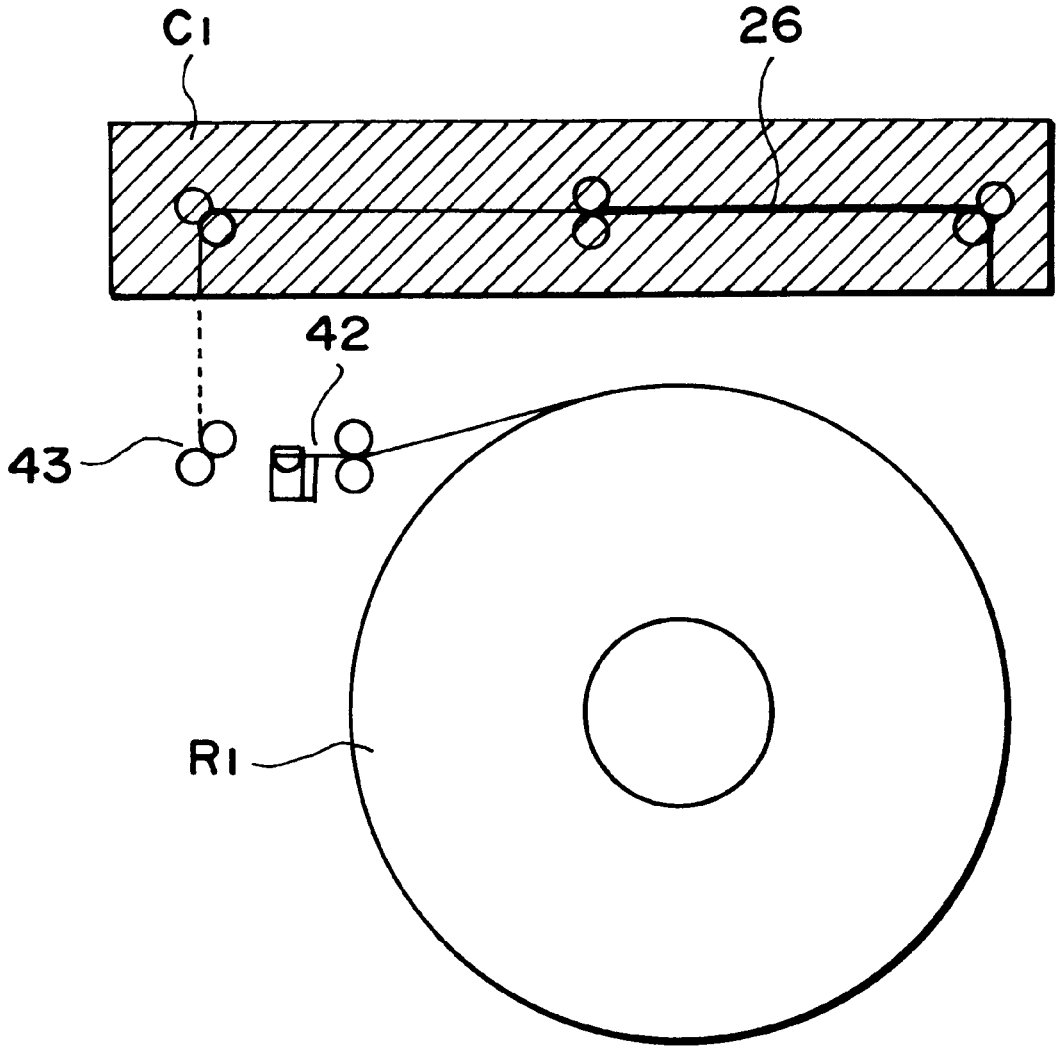
FIG. 6 is a side view of the tape reel and carriage of a tape conveying apparatus.

The tapes wound on the tape reels R1 and R2, respectively, are cut to a predetermined length (binder tape 26), and is conveyed to the carriage C by the tape conveying means 42 (FIG. 6).

After the binding tape 26 is conveyed to the carriage C by the tape conveying means 43, the carriage C is moved from the tape receiving position C1 to the tape transferring position C2 (FIG. 7).

Figure 8:
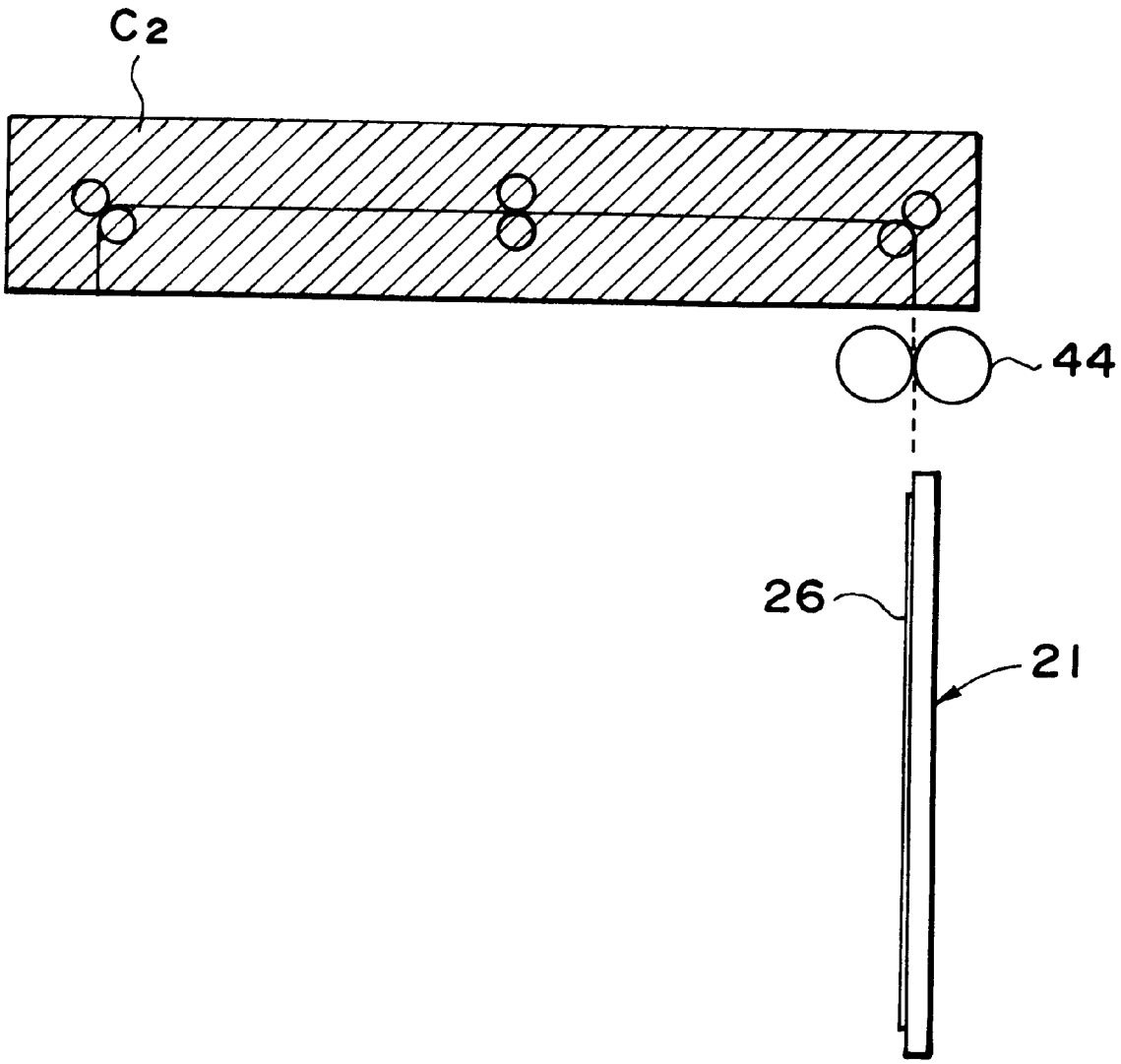
FIG. 8 is a side view of the carriage and the center heater portion of the tap conveying apparatus illustrated in FIG. 6.

After the movement of the carriage C from the tape receiving position C1 to the tape transferring position C2 is completed, the binder tape 26 is transferred onto the tape guide portions 19 and 20 by the tape conveying means 44 (FIG. 8).

After the transfer of the binding tape 26, the central heater 21 is moved by the driving mechanism 24 from the home position (unillustrated) to the heating position (FIG. 2), and is activated to preheat the binding tape 26. Then, the set of aligned sheets are moved to a position at which the leading end side of the sheet set, that is, the side which will become the back portion of a book after the set of sheets are bound into the form of a book, is positioned at a point H indicated in FIG. 2 (FIG. 2 and FIG. 4(*c*)), and at this position, the binding tape 26 is bonded to the "back portion" of the sheet set.

Upon completion of the bonding of the binding tape 26 to the "back portion" of the sheet set, the side heaters 22 and 23 are driven by the driving mechanism 25 (unillustrated). More specifically, as the tape guide 19 and 20 are retracted, the side heaters 22 and 23 catch the opposing peripheral portions (top and bottom peripheral portions in FIG. 7) of the binding tape 26, and are folded onto the top and bottom surfaces, respectively, of the sheet set so that the opposing peripheral portions of the binding tape 26 are bonded to the sheet set in a manner to wrap the leading edges of the top and bottom surfaces, respectively, of the sheet set. Upon completion of the bonding of the peripheral portions of the binding tape 26 to the leading edges of the top and bottom surfaces, respectively, of the sheet set, the pressure from the side heaters 22 and 23 is removed.

Figure 5A:
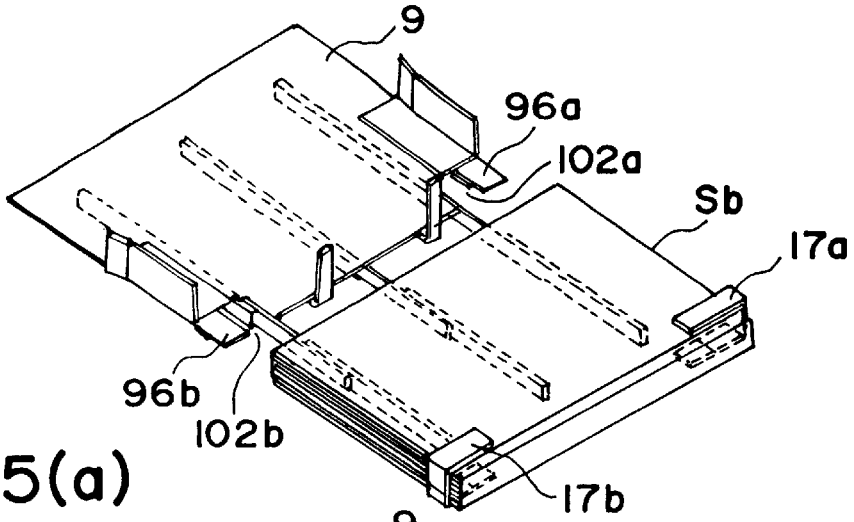
FIGS. 5(*a*), 5(*b*), and 5(*c*) are perspective views of the sheet storing apparatus, depicting different stages of the return of the sheet conveying apparatus after sheet set delivery.
Figure 5B:
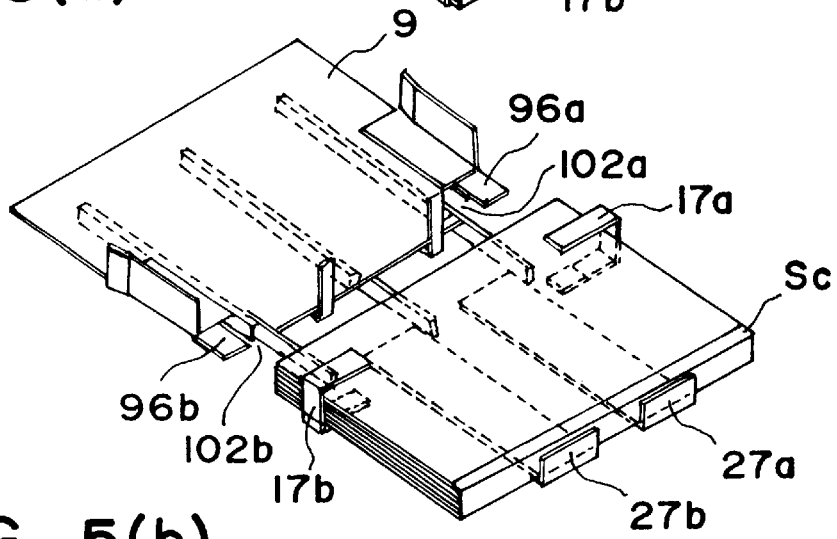
Figure 5C:
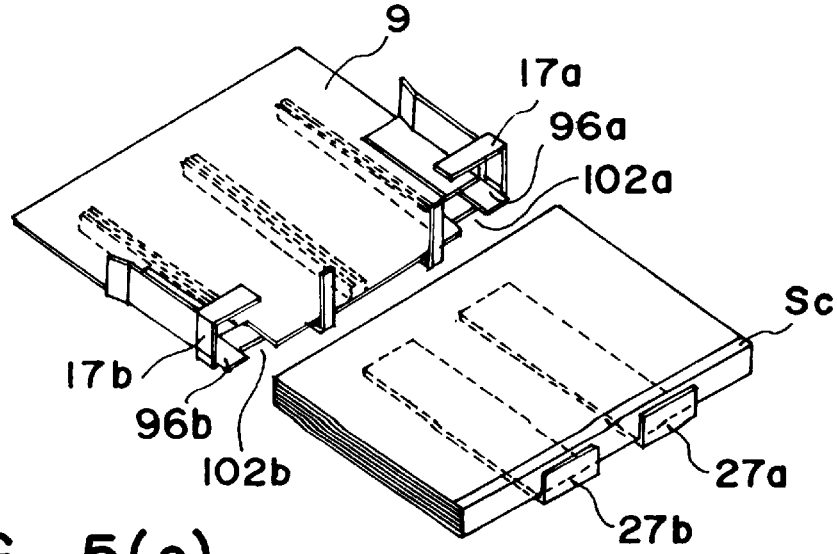

Upon removal of the pressure from the side heaters 22 and 23, the bound sheet set, that is, a product finished as a book Sc, is conveyed by the sheet set conveying apparatus 203 from the binding position to a transfer point from which the finished book Sc is transferred onto the bound sheet set conveying apparatus 206 (FIG. 5(*a*)).

At this point of time, the central heater 21 and the side heaters 22 and 23 are retracted to their home positions by the central heater driving mechanism 24 and the side heater driving mechanism 25, respectively, in order to allow the next binding tape to be delivered to the tape guide portion.

The bound sheet set conveying apparatus 206 comprises a bound sheet set receiver tray 27, a bound sheet set conveyer tray 28, driving means 29 and 30 for the bound sheet set receiver tray 27, driving means 31 and 32 for the bound sheet set conveyer tray, vertically conveying means 33 and 34, and the like.

As soon as the bound sheet set Sc is conveyed by the sheet set conveying apparatus 203 from the binding position, which is correspondent to the binding point H, to the transfer point of the bound sheet set conveying apparatus 206, the receiver tray 27 is moved by the driving means 29 and 30 to the bound sheet set receiving point.

Upon arrival of the receiver tray 27 at the bound sheet set receiving point, the bound sheet set Sc is released from the grip of the movable gripping plate 17 and stationary gripping plate 16 of the sheet conveying apparatus 203, into the receiver tray 27. Then, the sheet set conveying apparatus 203 is returned to the position correspondent to the sheet aligning position of the sheet storing apparatus 202 (FIG. 5(*b*)).

Upon reception of the bound sheet set Sc (FIG. 5(*c*)), the receiver tray 27 is moved by the driving means 29 and 30 to a transfer point T (FIG. 2) at which the bound sheet set Sc is transferred onto the bound sheet set conveyer tray 28.

Figure 9A:
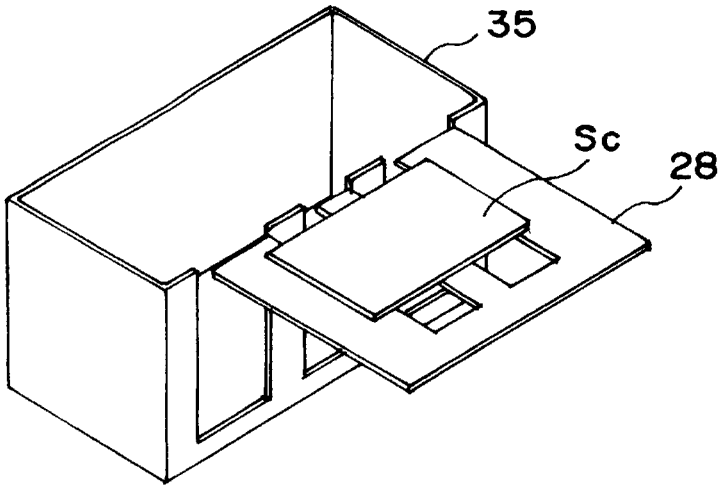
FIGS. 9(*a*), 9(*b*) and 9(*c*) are perspective views of a stacker, depicting how a set of sheets is stored in the stacker.
Figure 9B:
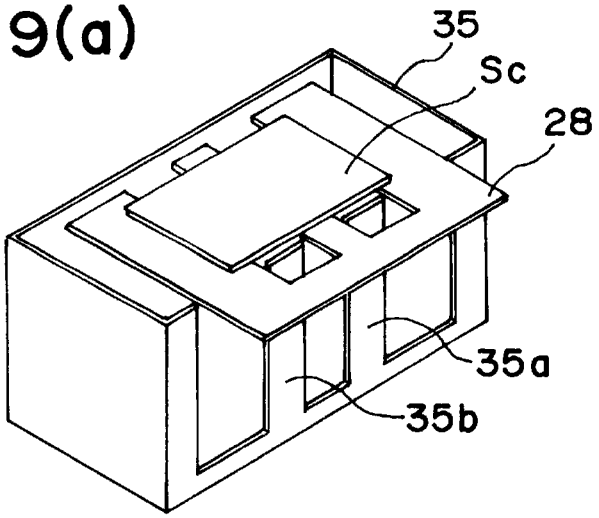
Figure 9C:
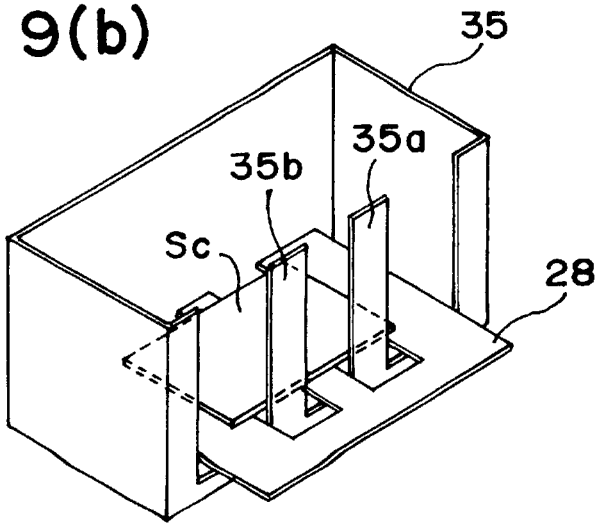

Upon receiving the bound sheet set Sc at the transfer point T, the bound sheet set conveyer tray 28 is moved by the driving means 31 and 32 to a position above the stacking type storage 35 (FIG. 9(*a*)). Then, the bound sheet set Sc is lowered into the stacking type storage 35 by the vertically conveying means 33 and 34 (FIG. 9(*b*)).

Thereafter, the bound sheet set conveyer tray 28 is horizontally moved away from the stacking type storage 35, leaving the bound sheet set Sc stacked in the stacking type storage 35 since the horizontal movement of the bound sheet set Sc is blocked by the comb-like portion of the stacking type storage 35 (FIG. 9(*c*)).

Next, the operational timing of the aligning fence 10 (10*a*, 10*b*) which aligns the sheet S delivered to the storage tray 9 will be described.

Referring to FIG. 2, on the upstream side and adjacent to the sheet conveying roller pair 8, an aligning timing sensor (timing detecting means) 300 which sets the operational timing for the aligning fence 10 is disposed.

At the sheet entrance 2*a* of the binding apparatus 1, a sheet interval detecting sensor 301 (sheet interval detecting means) which detects sheet interval in terms of time or distance is disposed. This sheet interval detecting sensor 301 also functions as a jam detecting sensor; when the sheet interval, in terms of time, detected by the sensor 301 is longer than a predetermined sheet interval, it is determined that the sheet S has jammed.

Figure 10:
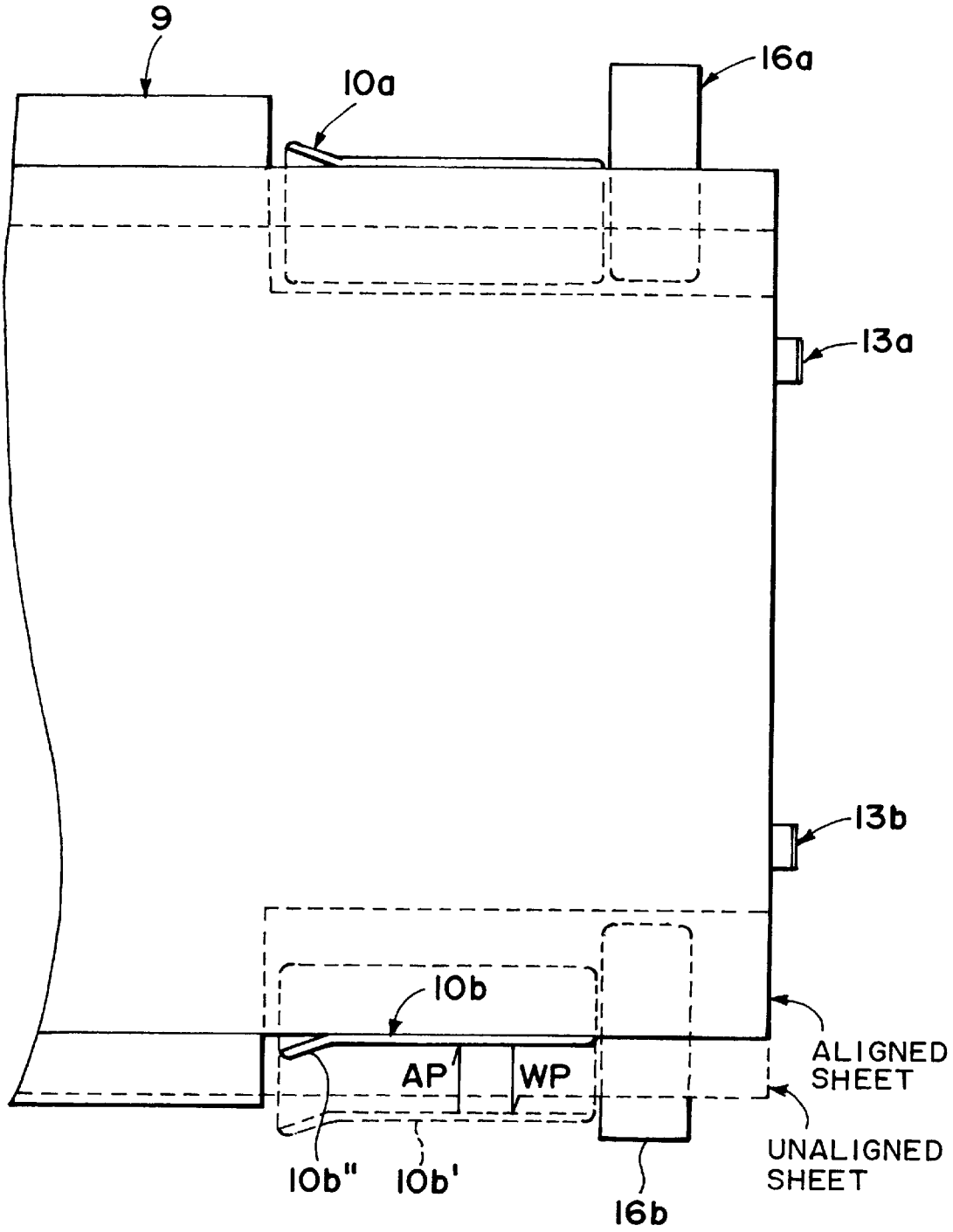
FIG. 10 is a plan of the storage tray and the aligning fences of the sheet storing apparatus.
Figure 12:
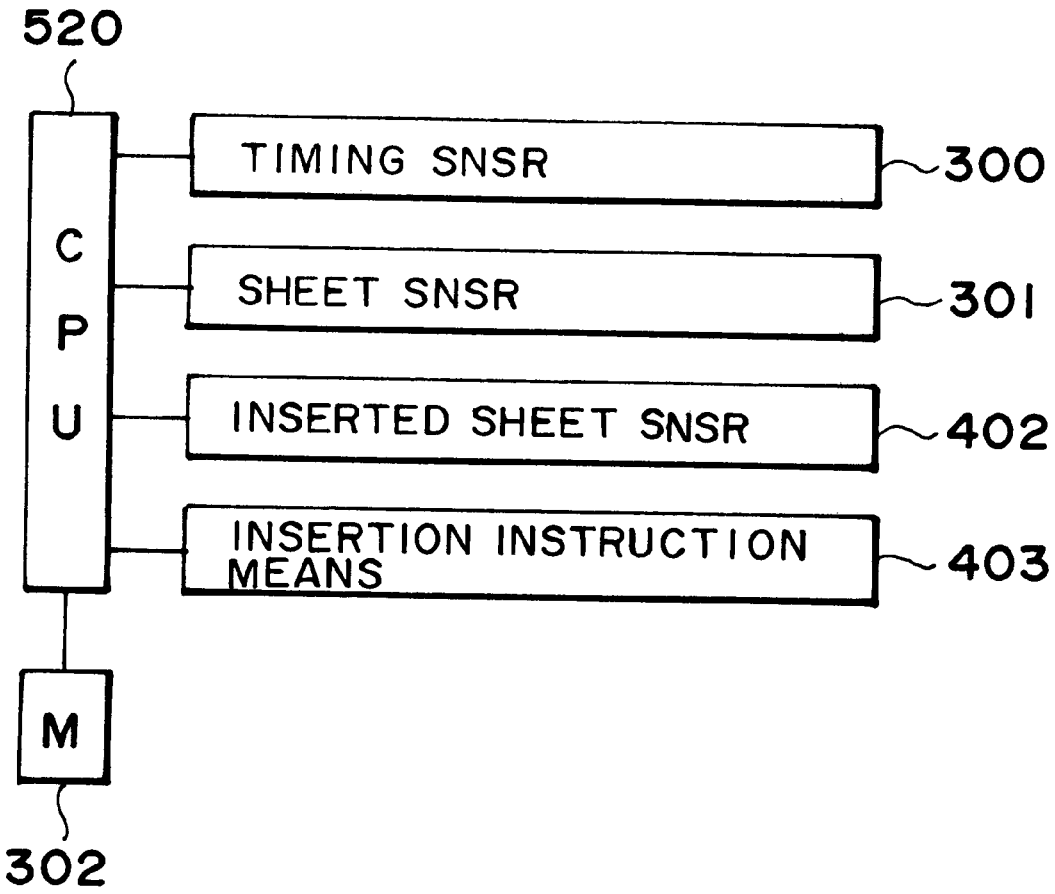
FIG. 12 is a schematic block diagram showing the control for the sheet storing apparatus in accordance with the present invention.

With a predetermined delay after the sheet S, which is being delivered into the sheet storing apparatus 202, is detected by the aligning timing sensor 300 illustrated in FIG. 2, in other words, after the sheet S is completely stored in the storage tray 9, the movable fence 10*b* of the aligning fence 10 is moved by a motor 302 as driving means (FIG. 12) from a standby position 10*b*' to an aligning position 10*b*" which is a predetermined distance away from the standby position (moved in the direction indicated by an arrow mark A in FIGS. 3 and 10), moving the sheet S toward the fixed fence 10*a*, that is, the lateral alignment reference, and thereby aligning the sheet S against the fixed fence 10*a*, and then is returned from the aligning position 10*b*" to the standby position 10*b*' (moved in the direction indicated by an arrow mark B in FIGS. 3 and 10).

During the above described conveyance of the sheet S, the sheet interval sometimes becomes longer than a predetermined interval due to fluctuation in the speed of an apparatus, for example, an image forming apparatus, which delivers the sheet S to the sheet storing apparatus, or due to the slipping which occurs between the plurality of conveying rollers or the like of the sheet delivering apparatus and the sheet S.

As described above, as a plurality of sheets are continuously conveyed into the sheet storing apparatus 202, sheet intervals are detected by the sheet detecting sensor 301 illustrated in FIG. 2. When the sheet detecting sensor 301 detects that one of the intervals is shorter than a predetermined interval, a controlling means 520 executes such control that the sheet aligning operation to be carried out by the movable fence 10b upon detection of a sheet is not carried out for the sheet immediately preceding the shorter interval.

As soon as sheet interval returns to the predetermined interval or longer in terms of time or distance, control is executed by the controlling means so as to restart the aligning operation in response to the signal from the aligning timing sensor 300.

In other words, when it is detected that the sheet interval of the sheets which are being continuously conveyed into the storage tray 9 is shorter in terms of time or distance than the interval necessary for properly aligning the sheets, the sheet aligning operation by the aligning fence 10 is not carried out to prevent the aligning fence 10 from improperly aligning the sheet in the storage tray 9.

EMBODIMENT 2

Figure 11:
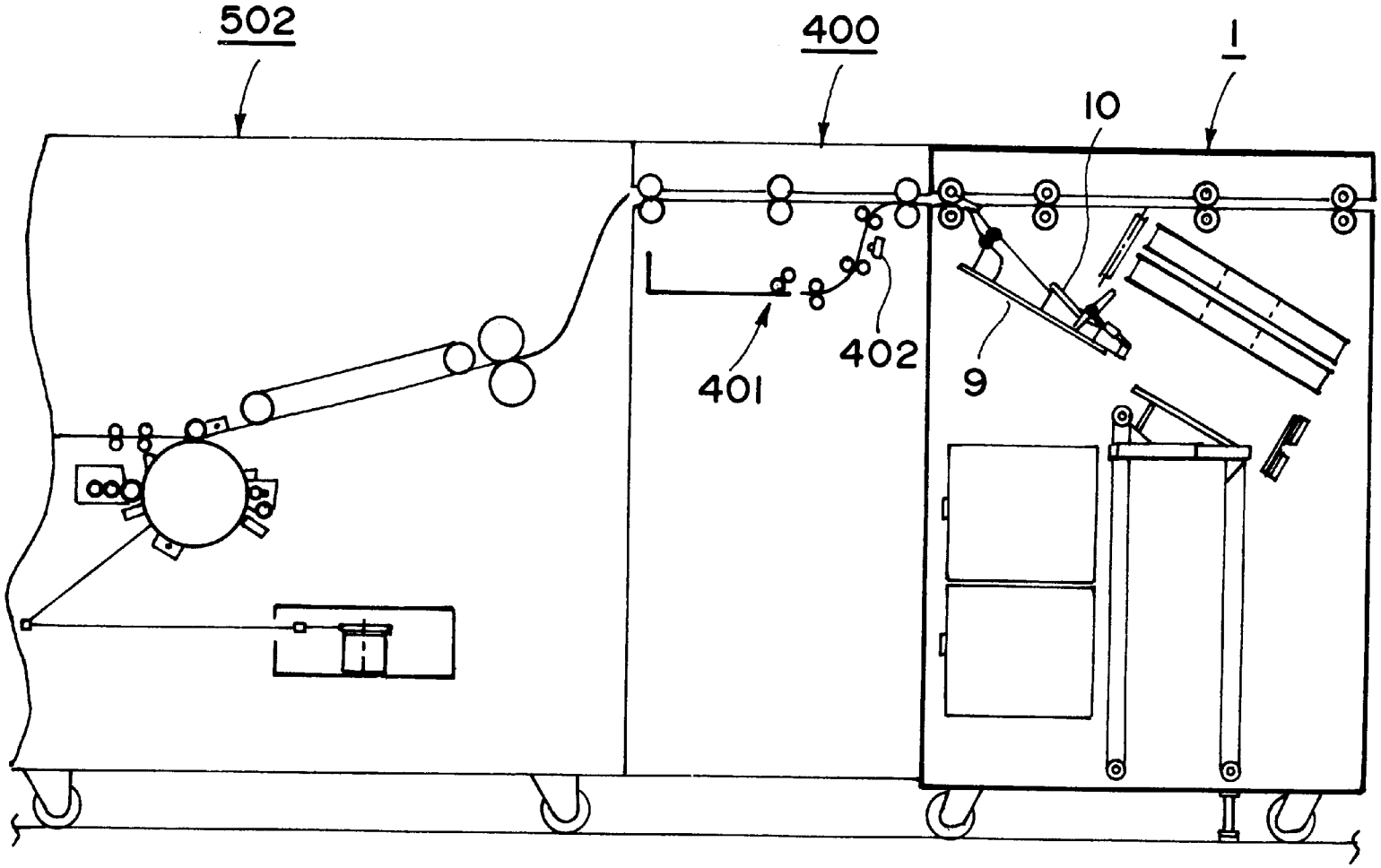
FIG. 11 is a vertical, longitudinal section of a portion of an on-line sheet processing apparatus, inclusive of the binding apparatus, which comprises the sheet storing apparatus in the second embodiment of the present invention, and an inserting apparatus connected to the binding apparatus.

FIG. 11 illustrates an on-line sheet processing apparatus to which an inserting apparatus 400 is connected, on the upstream side of the storage tray 9.

The inserting apparatus 400 has a sheet conveying path, through which a sheet S from an apparatus (for example, image forming apparatus) is delivered to a book making apparatus 1, that is, a binding apparatus, which has a storage tray 9.

In parallel to the sheet conveying path, an insert sheet tray 401, which holds insert sheets, is disposed. An insertion instruction issuing means 403 is used when it is necessary to issue an instruction for inserting an insert sheet between predetermined two sheets being conveyed into the storage tray 9. An insert sheet fed in response to the inserting instruction from the inserting instruction issuing means 403 is detected by an insert sheet detecting sensor 402 disposed in an insert sheet conveying path.

When an insert sheet is fed from the inserting apparatus 400 into the binding apparatus 1, between predetermined two sheets adjacent to each other (for example, the last sheet of the preceding sheet set which contains a predetermined number of sheets, and the first sheet of the following sheet set which contains a predetermined number of sheets) while a plurality of sheets are continuously conveyed from an image forming apparatus 502 to the book making apparatus 1, the following control is executed by the controlling means 520:

(1) whether or not the aligning operation by the aligning fence 10 should be carried out is determined based on the data regarding the insert sheet inserting point which is set when a command for activating the inserting apparatus 400 is issued; or (2) the driving mechanism for the aligning fence (unillustrated) is controlled by the controlling means 520 in response to the sheet detection signal from the insert sheet detecting sensor 402 so that the aligning operation by the aligning fence 10 is not carried out for the insert sheet and the sheet immediately preceding the insert sheet.

With the above arrangement, even when an insert sheet is inserted by the inserting apparatus, between the sheets being conveyed from the image forming apparatus 502, it is unnecessary to reduce the productivity of the image forming apparatus 502 to increase the sheet interval, and also, it is unnecessary to increase the speed at which the sheet S is conveyed to the sheet storing apparatus 1, in order to secure the time necessary for the aligning operation, in other words, the sufficient sheet interval, in anticipation of sheet insertion from the inserting apparatus 400.

EMBODIMENT 3

Figure 13:
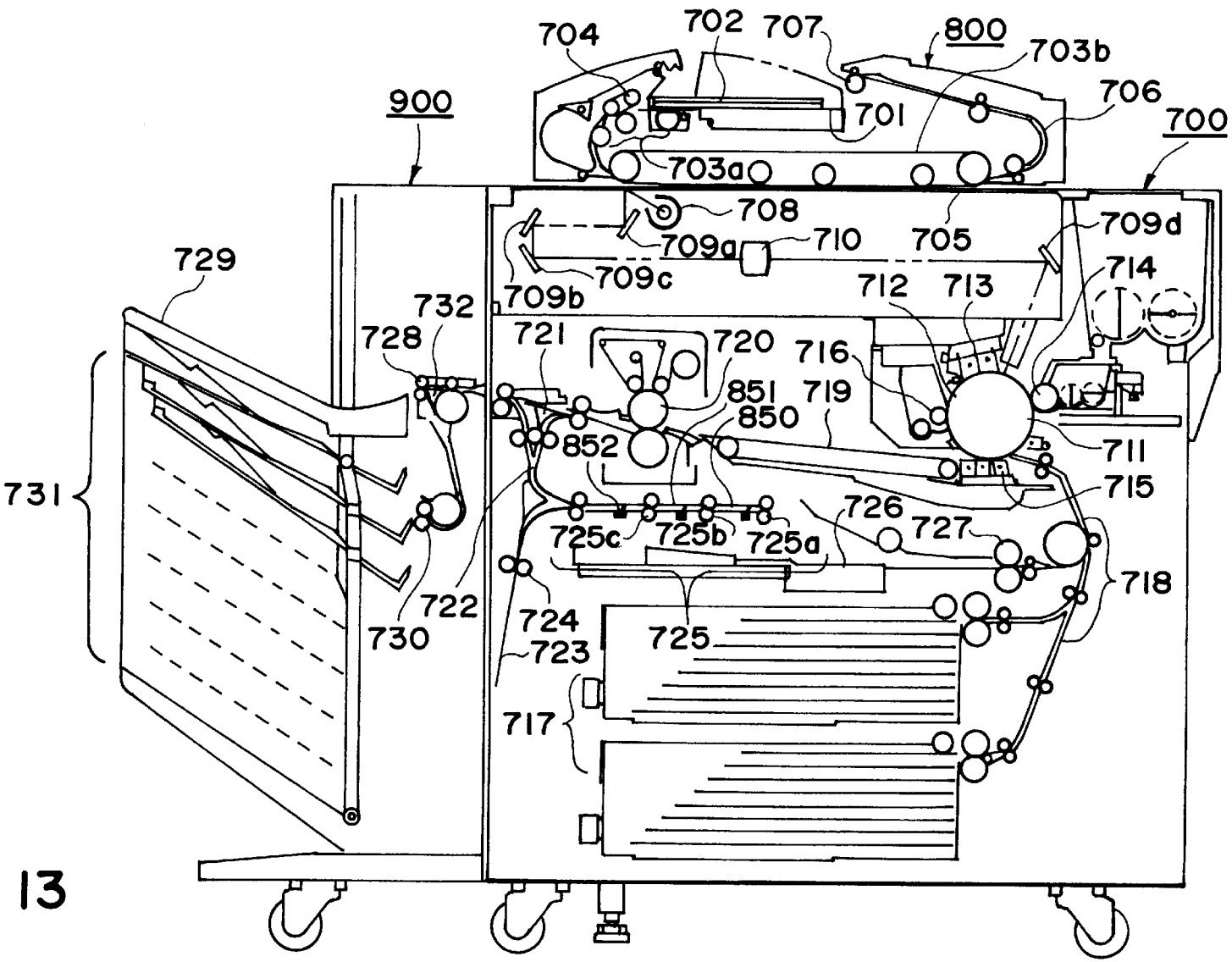
FIG. 13 is a vertical section of an image forming apparatus employing the sheet storing apparatus in the second embodiment of the present invention, parallel to the front panel of the image forming apparatus.

FIG. 13 illustrates an image forming apparatus 700 which is equipped with an original feeding apparatus 800 and a finishing apparatus 900.

From a set of original sheets 702 placed in the original placement tray 701 of the original feeding apparatus, the original sheets 702 are separated one by one by an original separating means 704 and each original sheet 702 is conveyed onto a platen glass 705, being properly positioned thereon, by an original conveying means 703 (703*a*, 703*b*). Then, the original 702 is read by an optical system, and thereafter, it is conveyed farther through an original returning path 706, and is discharged into the original placement tray 701 by an original discharging roller 707.

The original 702 properly positioned on the platen glass 701 by an original feeding apparatus 700 is scanned by a light beam from an exposure lamp 708, and the reflected portion of the light beam is projected, being focused, onto a photosensitive drum 711 as an image bearing member by an optical system comprising a deflection mirror 709 (709*a*, 709*b*, 709*c*, and 709*d*), a zoom lens 710, and the like. As a result, an optical image of the original 702 is formed on the photosensitive drum 711.

The photosensitive drum 711 is rotatively supported, and is surrounded by the exposure lamp 712, a corona type charger 713, a developing device 714, a transferring apparatus 715, and a cleaning apparatus 716.

As for the image forming process, the photosensitive drum 711 is rotated, and the residual charge on the photosensitive drum 711 is removed by the exposure lamp 712. Then, the photosensitive drum 711 is uniformly charged by the charger 713. Next, the uniformly charged photosensitive drum 711 is exposed to the optical image of the original to form a latent image on the photosensitive drum 711.

Next, the developing device 714 is activated to develop the latent image formed on the photosensitive drum 711. As a result, a resin based toner image is formed on the photosensitive drum 711.

The toner image formed on the photosensitive drum 711 is transferred by the transferring apparatus 715, onto a sheet which is fed from a sheet feeding cassette 717 and is delivered through a sheet conveying path 718 to a predetermined position where the sheet faces the photosensitive drum 711.

Upon completion of the toner image transfer onto the sheet, the sheet is guided through a conveying portion 719 to a heating roller type fixing device 720, in which the toner image is thermally fixed to the sheet. Then, the sheet is conveyed to a sorting apparatus 900 connected to the image forming apparatus 700.

Meanwhile, the photosensitive drum 711 is cleaned of the residual toner on the peripheral surface by the cleaning apparatus 716, to be used for the following image forming cycle.

When an image is formed on both surfaces of a sheet, a sheet conveying path switching guide 721 is driven after the sheet passes through the fixing device 720. As a result, the sheet is guided into a sheet reversing path 723 through a sheet conveying vertical path. Then, a sheet reversing roller 724 is rotated in reverse to convey the sheet in the opposite direction, turning the trailing end of the sheet, that is, the sheet edge which is trailing when the sheet is guided into the reversing path 723, into the leading end, and the sheet is discharged into an intermediary tray (storing means) 726 by a discharge roller (delivering means) 725 for double-sided image formation.

After being aligned in the intermediary tray 726, the sheet is refed into the sheet conveying path 718 by a refeeding roller 727 (refeeding means), so that an image is formed on the reverse side of the sheet through the aforementioned image forming process.

After the toner image on the sheet is fixed to the sheet by the fixing apparatus 720, the sheet is conveyed to the sheet sorting apparatus 900, in which the sheet is guided by a sheet path switching guide 732 to be discharged into a non-sorting tray 729 by a discharge roller 728 for the non-sorting tray, or into a sorting tray 731 by a discharge roller 730 for the sorting tray 731.

Next, the sheet interval at the time of sheet feeding from the sheet feeding cassette 717, and the sheet interval at the time of sheet reversing, will be described.

Figure 14:
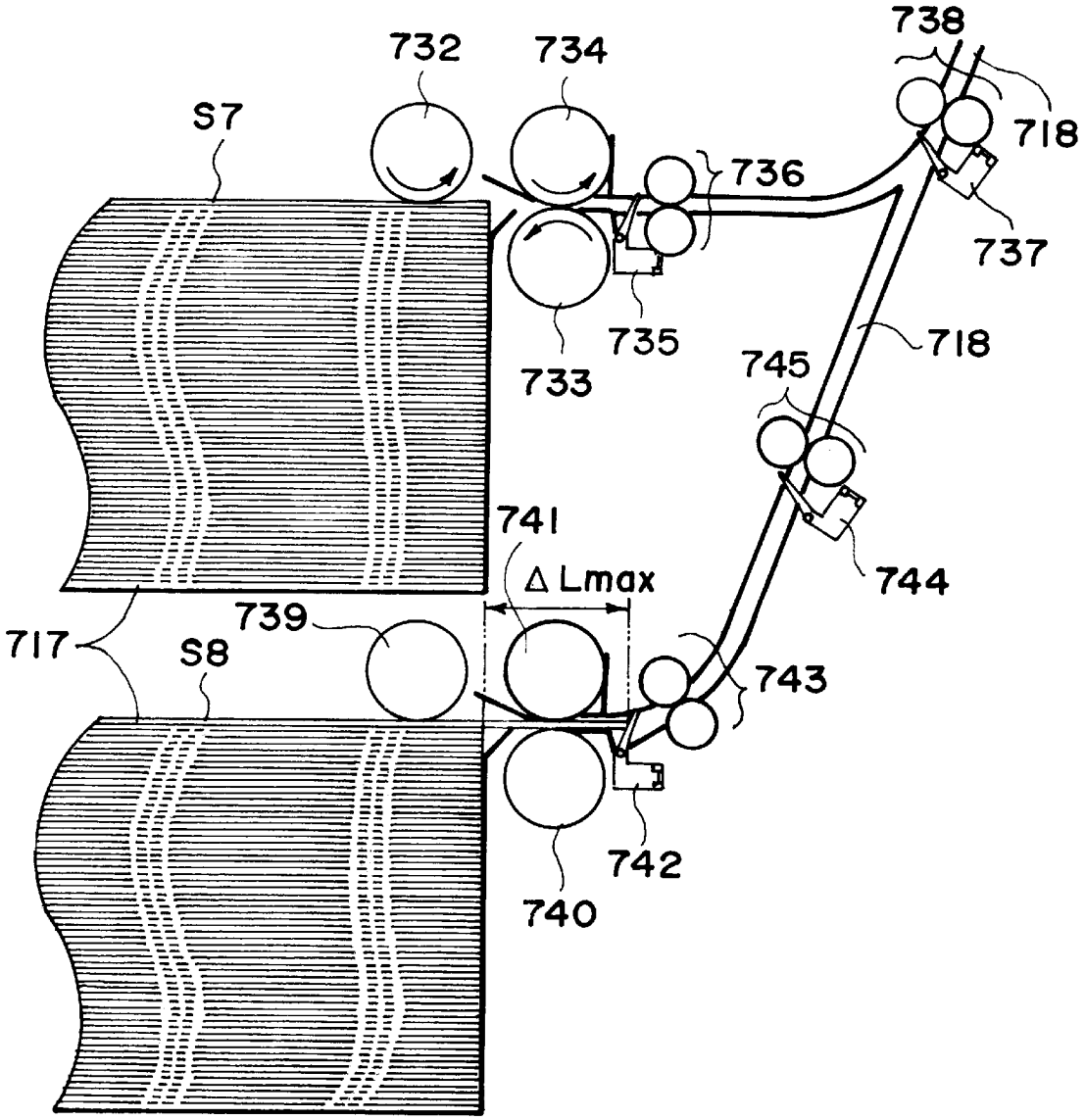
FIG. 14 is a vertical section of the sheet feeding portion of the image forming apparatus illustrated in FIG. 13.

FIG. 14 is a section of the sheet feeding roller which feeds out sheets one by one from the sheet feeding cassette 717, and the adjacencies of the roller.

In FIG. 14, a reference character S7 designates the set of sheets placed in the sheet feeding cassette 717: S8, two sheets being fed out together: 732 and 739, a pickup roller; 733 and 740, a reversing roller; 734 and 741, a feeding roller; 735, 737, 742, and 744, a sheet detecting sensor; and 736, 738, 743, and 745 designates a conveyer roller pair.

The sheets within the sheet feeding cassette 717 are fed out of the cassette one by one, and each sheet is conveyed to the nip of a retardation based separating roller pair (reversing rollers 733 and 740 coupled with feeding rollers 734 and 741, respectively), by the pickup roller 732 or 739.

When sheets have not been fed out in plurality, the torque limit of the torque limiter (unillustrated) contained in the reversing roller 733, and the torque limit of the torque limiter in the reverse roller 740, are no greater than the sheet conveying force generated by the friction between the sheet and the feeding rollers 734 and 741, respectively, and therefore, the reversing rollers 733 and 740 are caused to follow the rotation of the feeding roller 734 and 741, respectively, allowing the sheets to be conveyed one by one toward the image forming portion through the sheet conveying path 718 by the conveyer rollers 736, 738, 743, and 745.

On the other hand, when sheets are fed out in plurality (two or more sheets are fed out together), the sheets which are not in contact with the feeding roller 734 or 741 are conveyed in the direction opposite to the normal sheet feeding direction by the rotation of the reversing roller 733 or 740 (rotation in the direction opposite to the rotation of the feeding roller: rotation in the direction to return a sheet toward the sheet feeding cassette), and only the sheet in contact with feeding roller 734 or 741 is conveyed in the normal sheet feeding direction toward the image forming portion through the sheet conveying path 718 by the conveyer rollers 736, 738, 743, and 745. This is because the torque limit of either torque limiter is set to be less than the magnitude of the friction between the feeding roller and any given sheet or the magnitude of the friction between the reversing roller and any given sheet, but greater than the friction between any given two sheets.

In the case of a structure which employs the above described retardation based system to separate the plurality of sheets fed out together, the friction between any given sheet and a feeding or a reversing roller varies depending on the type of the sheet and the changes which occur to the roller with elapse of time, and therefore, the sheet separating performance thereof changes. As a result, it becomes possible that some of the sheets which are fed out together but retained temporarily by the reversing roller may be in a state of being slightly advanced in the sheet conveying direction compared to those in the sheet feeding cassette 717.

It is possible that the distance L the sheets fed out in plurality is advanced is as large as the distance from the position of a sheet placed in the feeding cassette 717 to the position of the sheet detecting sensor capable of detecting the sheets conveyed together. However, the timing for the toner image formation on the photosensitive drum 711 is controlled by driving the optical system in response to each of the properly fed sheets, and therefore, no problem occurs.

While a toner image is fixed to a sheet by a fixing device employing a heat roller, the sheet is covered with silicon oil which is applied to the rollers to improve the separativeness of the rollers from the sheet, and therefore, the frictional coefficient of the sheet becomes smaller. Consequently, slipping occurs sometimes between the sheets and a conveyer roller, in particular, a worn roller, causing the sheet interval to fluctuate.

In particular, this type of slipping is liable to occur when a sheet is reversed by a the reversing roller 724 (FIG. 13) during double-sided image formation.

Therefore, when a plurality of sheets are continuously fed, sheet interval is liable to become is smaller in the area where the sheets are fed out of the sheet feeding cassette and/or in the area (inclusive of the area in which the reversing roller is disposed) where the sheets are further conveyed after a toner image is fixed. In addition, sheet interval is liable to become smaller due to the fluctuation of the speed of the conveyer motor.

Next, the sheet aligning operation in the intermediary tray 726 will be described.

Figure 15:
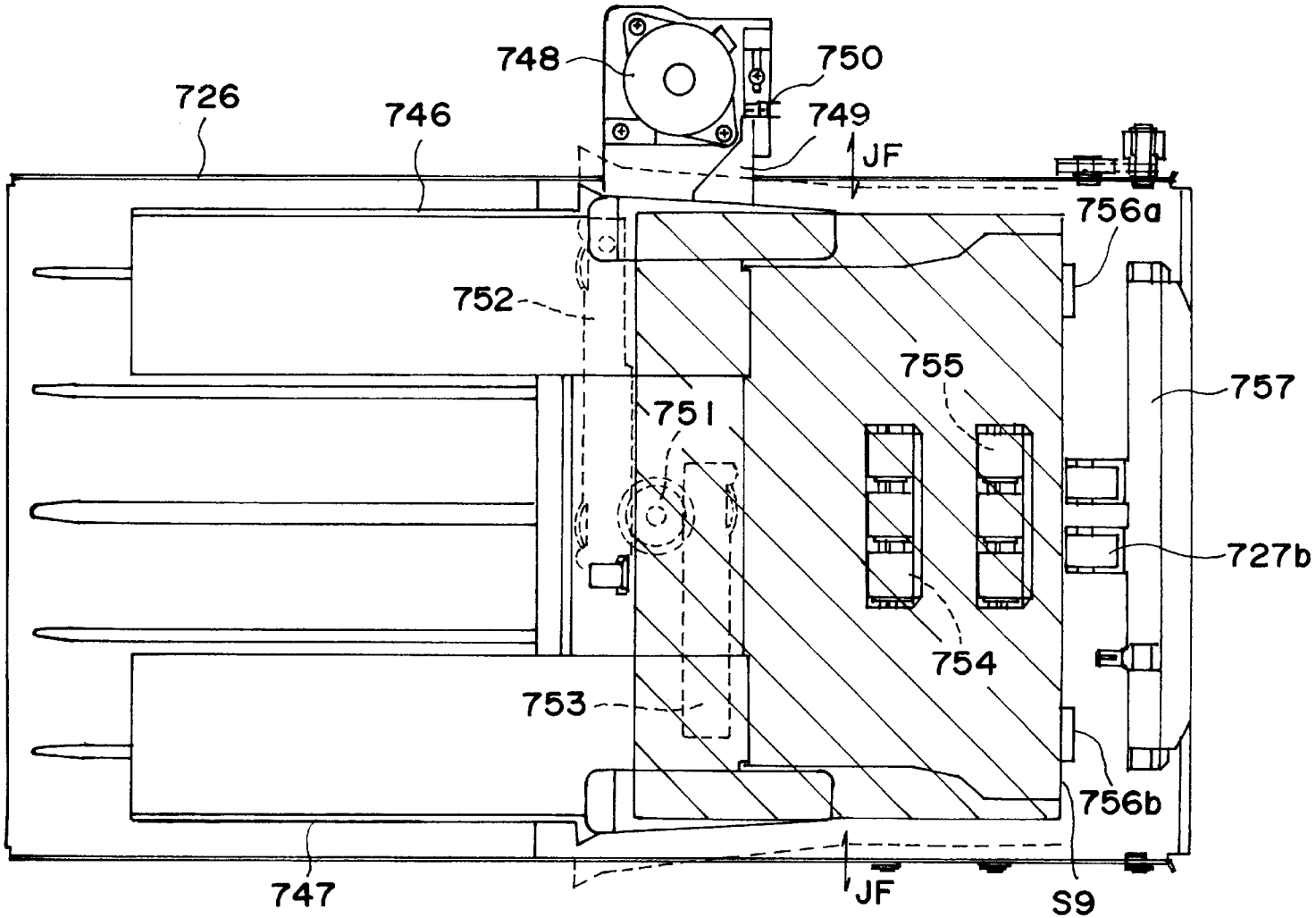
FIG. 15 is a plan of the intermediary tray portion of the same.

FIG. 15 is a plan of the intermediary tray 726. Reference numerals 746 and 747 designate an aligning fence (aligning means); 748, an aligning fence driving stepping motor; 749, a flag portion for detecting the aligning fence position; 750, an aligning fence position detecting sensor; 751, a transmission gear pulley: 752 and 753, a driving rack; 754 and 755, a kicker roller; 756 (756*a*, 756*b*), a leading edge reference shutter; and a reference numeral 757 designates a conveyer roller.

Each sheet is conveyed into the intermediary tray 726 by the discharge roller 725 (725*a*, 725*b*, and 725*c*) for the double-sided printing. As for the aligning in the sheet conveyance direction, each sheet is aligned as it bumps against the leading edge reference shutter 756 (756*a* and 756*b*).

On the other hand, in order to aligning a sheet at the lateral edge, that is, the edge parallel to the sheet conveyance direction, the aligning fences 746 and 747 are used. More specifically, the driving force from the aligning fence driving stepping motor 448 is transmitted to the intermediary transmission pulley by an unillustrated timing belt to move the driving rack 752 and 753 attached to the aligning fences 746 and 747. As a result, the aligning fences 746 and 747 are moved in the direction indicated by an arrow mark JF, to align the sheet.

The timing with which the aligning fences 746 and 747 are moved in the aligning direction is controlled by a CPU (controlling means) 860 (FIG. 16) in response to the output of sheet detecting sensors (sheet interval detecting means) 850, 851, and 852) disposed adjacent to the discharge roller 725 (725*a*, 725*b*, and 725*c*) for double-sided printing.

Figure 16:
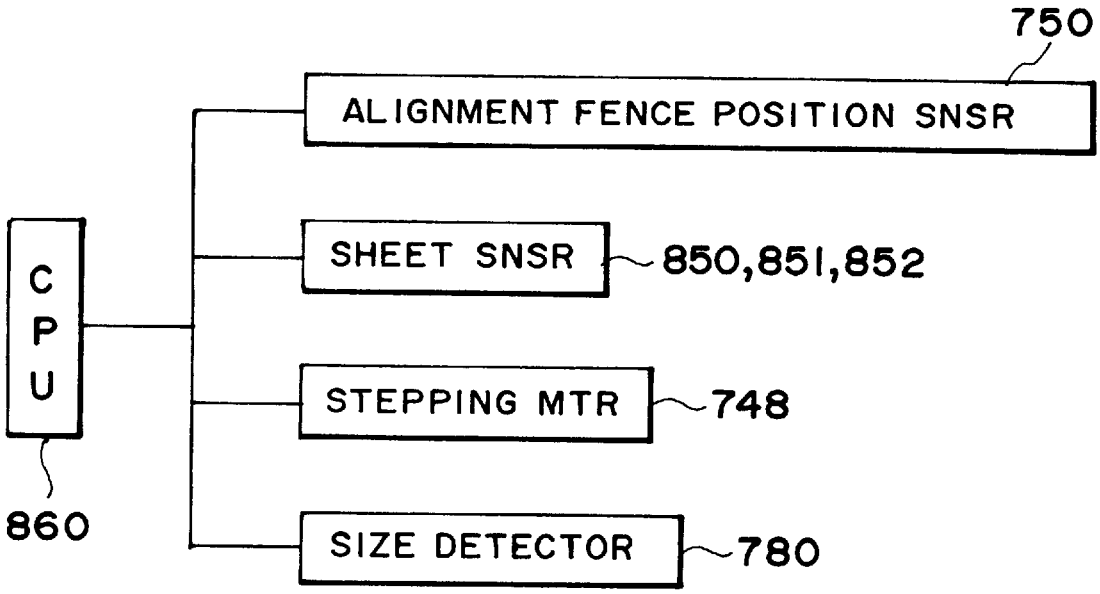
FIG. 16 is a schematic block diagram for the control for the sheet storing portion of the same.

More specifically, the CPU 860 determines whether or not the aligning fences 746 and 747 are at their home positions, based on the output from the aligning fence position detecting sensor 750 which detects the flag portion 749 of the aligning fence 746, and drives the aligning fence driving stepping motor 748 in response to the output from the sheet detecting sensors 850, 851 or 852 (FIG. 16).

Further, the CPU is connected to a sheet size detecting means 780 of the sheet feeding cassette, so that not only can the CPU control an unillustrated sheet exit switching means to switch the sheet exit according to sheet size, but also carry out initial control in which, before any given sheet is conveyed into the intermediary tray, the aligning fences 746 and 747 are moved from the home position to the sheet accommodating position (slightly outward of the lateral edge of an incoming sheet) according to the sheet size detected by the sheet size detecting means 780 of the sheet feeding cassette.

Figure 17A:
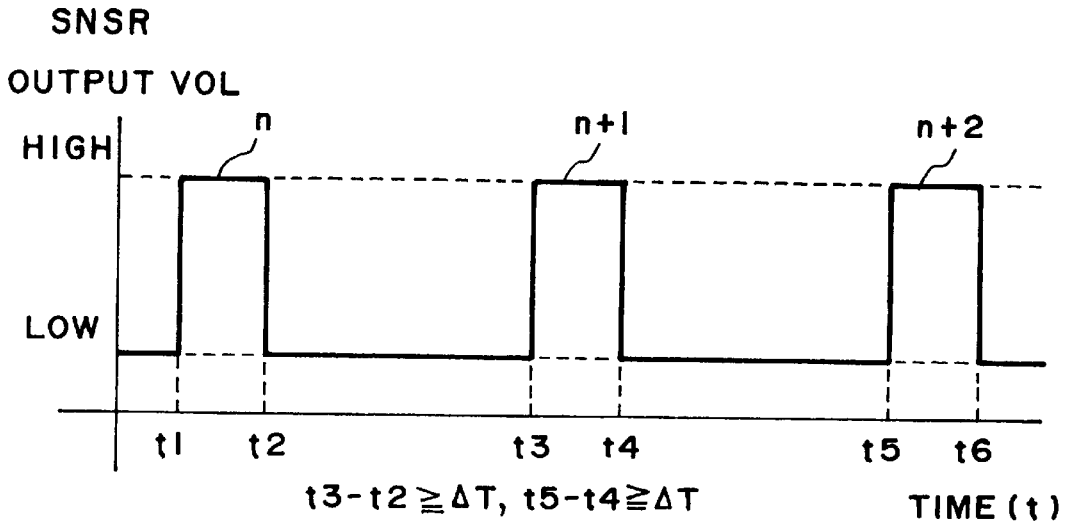
FIGS. 17(*a*) and 17(*b*) are timing charts for controlling the aligning fence stepping motor in response to the output of the sheet detecting sensor of the same.
Figure 17B:
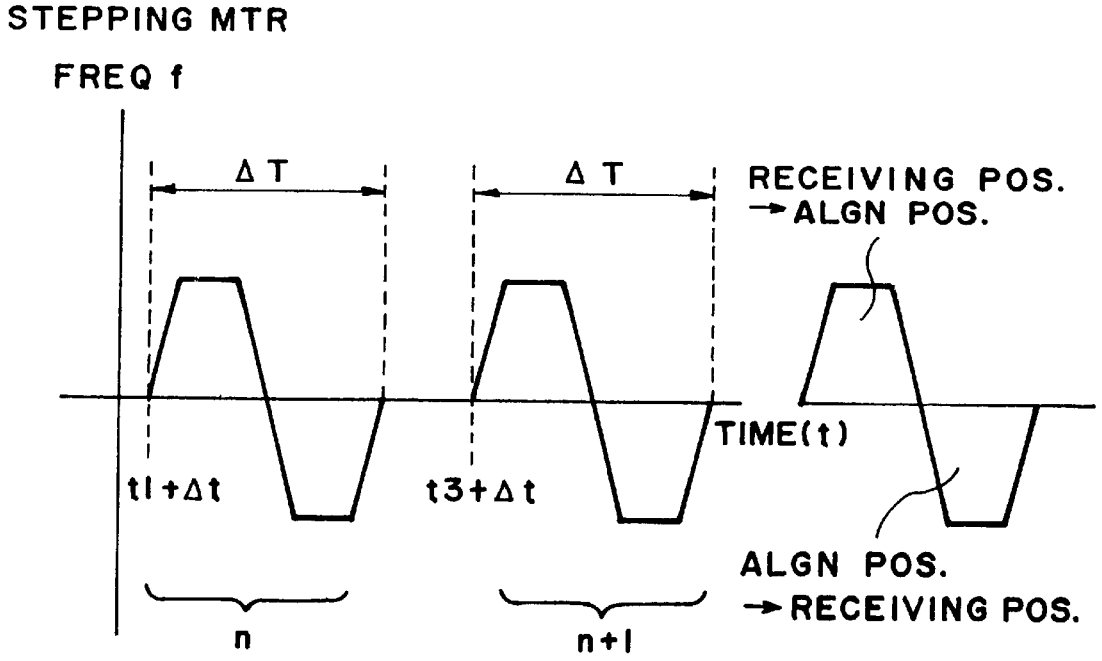

FIGS. 17(*a*) and 17(*b*), 18(*a*) and 18(*b*), and 19(*a*) and 19(*b*) each shows the relationship between the output voltage of the sheet detecting sensor 850, 851, or 852, and the driving control for the aligning fence driving stepping motor 748.

In FIGS. 17(*a*) and 17(*b*) referential figures n, (n+1), and (n+2) designate n-th sheet, (n+1)-th sheet, and (n+2)-th sheet, correspondingly, which are conveyed into the intermediary tray 726. Periods (t1→t2), (t3→t4), and (t5→t6) each designates a period in which any given sheet is being detected by the sheet detecting sensor (period in which the output voltage of the sheet detecting sensor is at a high level). Periods (t2→t3) and (t4→t5) each designates a sheet interval (period in which the output voltage of the sheet detecting sensor is at a low level). A referential figure ΔT designates the time (aligning time) necessary for the aligning fences 746 and 747 to shuttle once between the sheet receiving position and the sheet aligning position, and a referential figure Δt designates the time from when any given sheet is detected by the sheet detecting sensor to when the detected sheet bumps against the leading edge reference shutter 756 (756*a* and 756*b*) and stops.

As shown in FIG. 17(*a*), when the output of the sheet detecting sensors 850, 851, and 852 indicate that the sheet intervals (t3−t2) and (t5−t4) are greater than the aligning time ΔT (t3−t2≧ΔT, and t5−t4≧ΔT), the CPU 860 drives the aligning fence driving stepping motor 748 for a period equivalent to a predetermined number of pulses, as shown in FIG. 17(*b*), to align the sheet at the lateral edges perpendicular to the sheet conveyance direction.

Figure 18A:
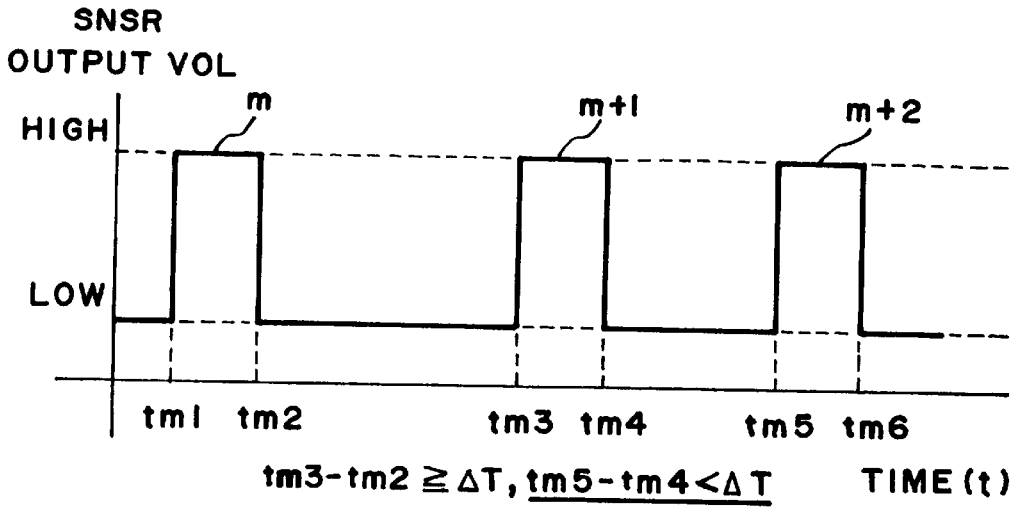
FIGS. 18(*a*) and 18(*b*) are timing charts for controlling the aligning fence stepping motor in response to the output of the sheet detecting sensor of the same.
Figure 18B:
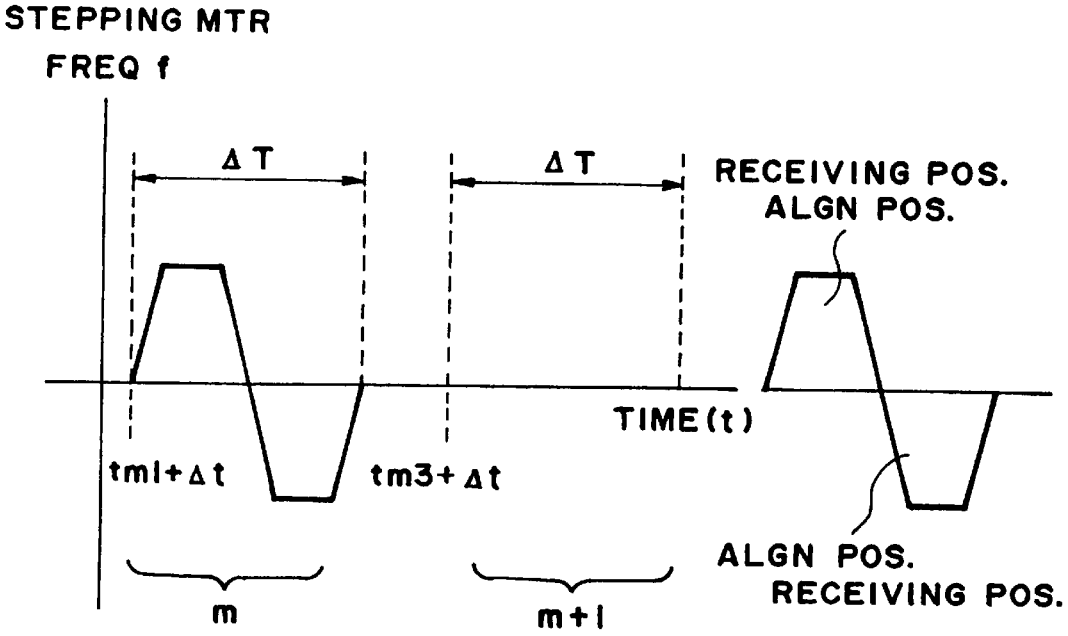

In FIGS. 18(*a*) and (*b*), referential figures m, (m+1), and (m+2) designate m-th sheet, (m+1)-th sheet, and (m+2)-th sheet, correspondingly, which are conveyed into the intermediary tray 726. Periods (tm1→tm2), (tm3→tm4), and (tm5→tm6) each designates a period in which any given sheet is being detected by the sheet detecting sensor (period in which the output voltage of the sheet detecting sensor is at a high level). Periods (tm2→tm3) and (tm4→tm5) each designates a sheet interval (period in which the output voltage of the sheet detecting sensor is at a low level). A referential figure ΔT designates the time (aligning time) necessary for the aligning fences 746 and 747 to shuttle once between the sheet receiving position and the sheet aligning position, and a referential figure Δt designates the time from when any given sheet is detected by the sheet detecting sensor to when the detected sheet bumps against the leading edge reference shutter 756 (756*a* and 756*b*) and stops.

When the sheet interval (tm5−tm4) is not greater than the aligning time ΔT (tm5−tm4<ΔT), the CPU 860 does not drive the aligning fence driving step motor 748 until it is detected that the sheet interval is greater than the aligning time ΔT necessary for the aligning fences 746 and 747.

Figure 19A:
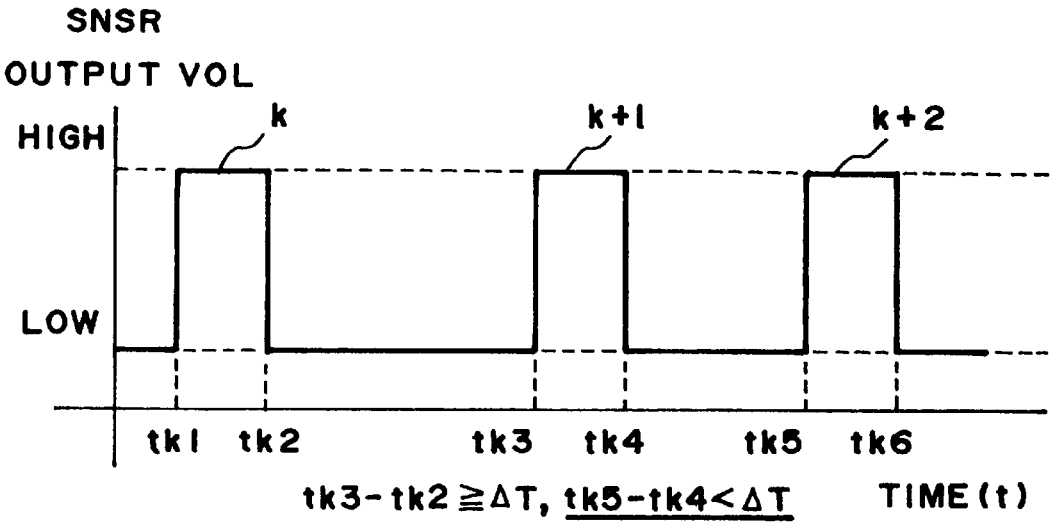
FIGS. 19(*a*) and 19(*b*) are timing charts for controlling the aligning fence stepping motor in response to the output of the sheet detecting sensor of the same.
Figure 19B:
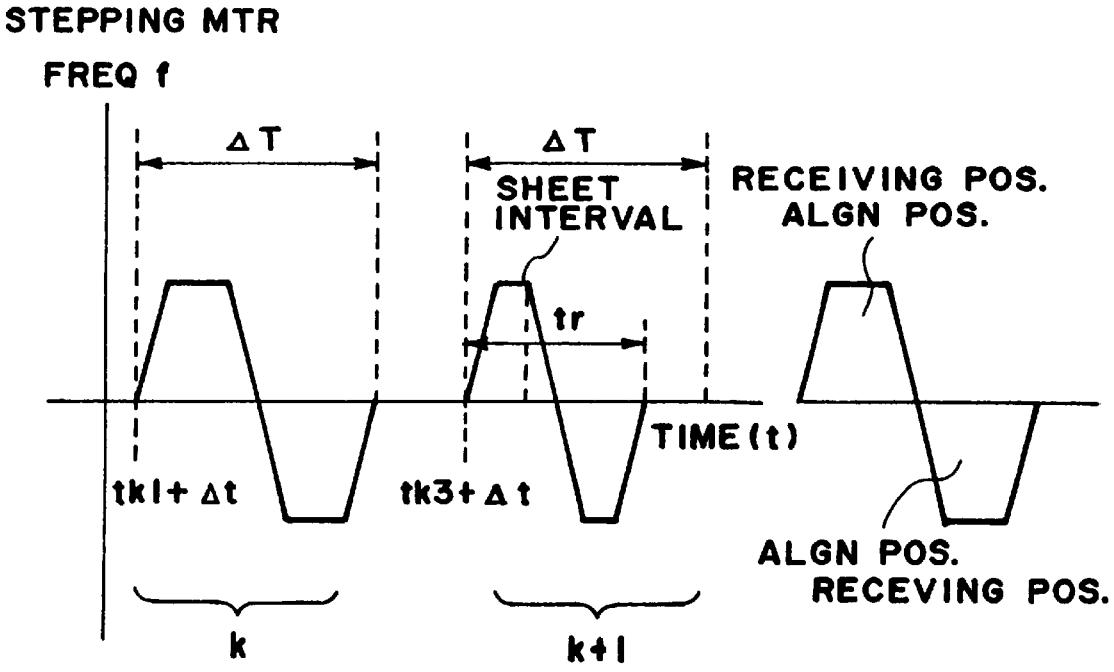

Next, referring to FIGS. 19(*a*) and 19(*b*), referential figures k, (k+1), and (k+2) designate k-th sheet, (k+1)-th sheet, and (k+2)-th sheet, correspondingly, which are conveyed into the intermediary tray 726. Periods (tk1→tk2), (tk3→tk4), and (tk5→tk6) each designates a period in which any given sheet is being detected by the sheet detecting sensor (period in which the output voltage of the sheet detecting sensor is at a high level). Periods (tk2→tk3) and (tk4→tk5) each designates a sheet interval (period in which the output voltage of the sheet detecting sensor is at a low level). A referential figure ΔT designates the time (aligning time) necessary for the aligning fences 746 and 747 to shuttle once between the sheet receiving position and the sheet aligning position, and a referential figure Δt designates the time from when any given sheet is detected by the sheet detecting sensor to when the detected sheet bumps against the leading edge reference shutter 756 (756*a* and 756*b*) and stops. A referential figure tr designates the time from when the aligning fence driving stepping motor 748 begins to be driven to when the aligning fence arrives at the sheet receiving position after any given sheet is detected (time tr is shorter than the period in which the sheet is being detected).

In a situation in which the sheet interval (tk5−tk4) is less than the aligning time ΔT (tk5−tk4<ΔT), and the aligning fence driving stepping motor 748 begins to drive the aligning fences before the sheet detection results of the sheet detecting sensors 850, 851 and 852 are outputted, the aligning fence driving stepping motor may be put in revese to return the aligning fences 746 and 747 to the sheet receiving position before they reach the aligning position.

In this situation, the CPU 860 controls the aligning fence driving stepping motor so that the time tr necessary for the aligning fences to return to the sheet receiving position becomes shorter than the sheet interval (tk5−tk4).

Further, the CPU 860 halts the aligning fence operation for a duration equivalent to a predetermined number of sheets. Then, the CPU 860 restarts the aligning operation after sheet interval becomes greater than the aligning time.

Upon completion of the sheet alignment, the aligned sheets are to be kicked out one by one from the bottom side of the sheet pile to the nip of a sheet recirculating roller pair 727 (727*a* and 727*b*). The two or more sheets which are occasionally conveyed together to the nip of the recirculating roller pair 727 are separated at the nip, and then sent one by one to the nip of the conveyer roller pair 757. Thereafter, each sheet is sent to the image forming station through the sheet path 718.

Figure 20A:
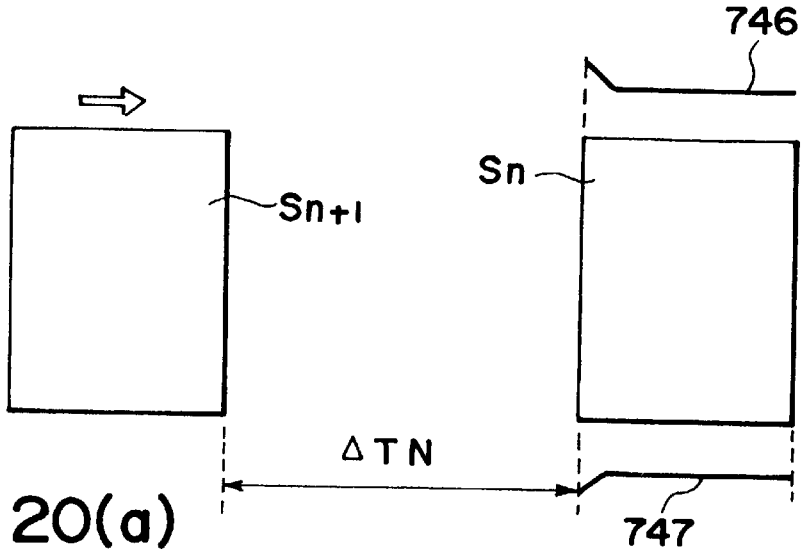
FIGS. 20(*a*), 20(*b*), and 20(*c*) are schematic drawings depicting the positional relationship between sheet size and the actual moving members of the aligning fence.
Figure 20B:
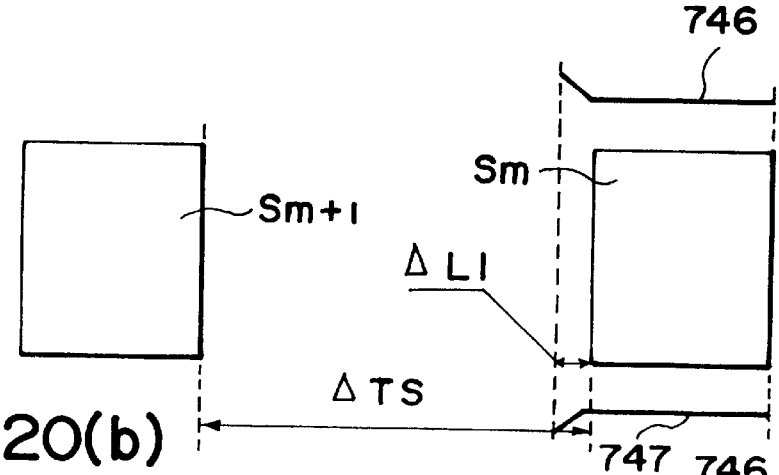
Figure 20C:
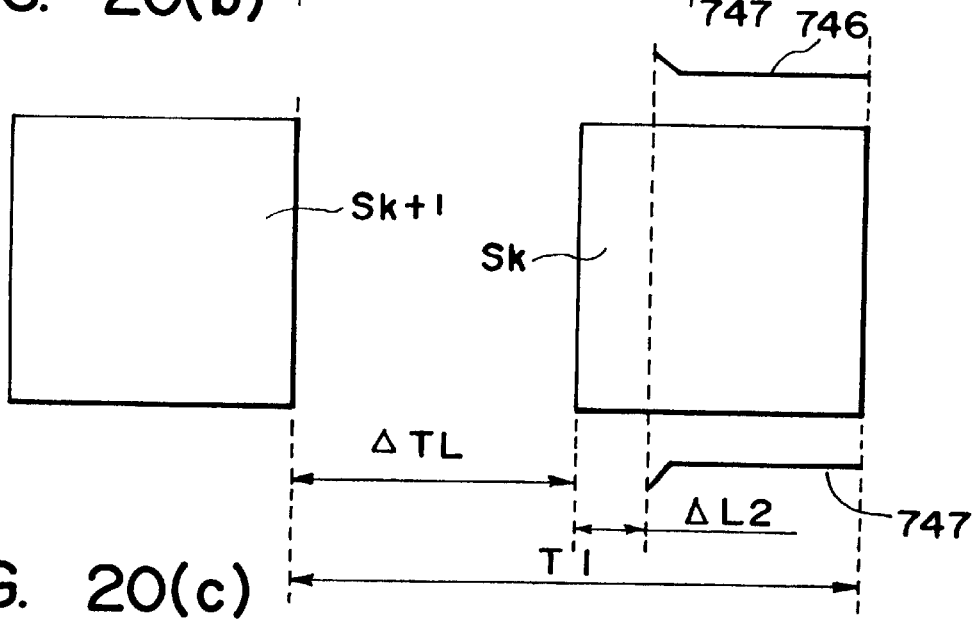
Figure 21A:
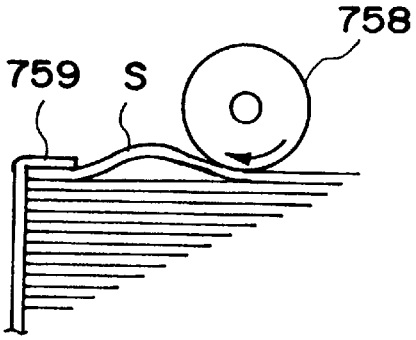
FIGS. 21(*a*), 21(*b*), 21(*c*), 21(*d*), 21(*e*), and 21(*f*) are schematic drawings depicting a variety of mechanisms for preventing two or more sheets from being fed together, wherein (a) represents a claw based separating mechanism; (b), a friction based separating mechanism; (c), a counter rotating rollers based separating mechanism; (d), a belt based separating mechanism; (e), a roller based separating mechanism; and (f) is a different view of the roller based separating mechanism illustrated in (e), as seen from the right-hand side of (e).
Figure 21B:
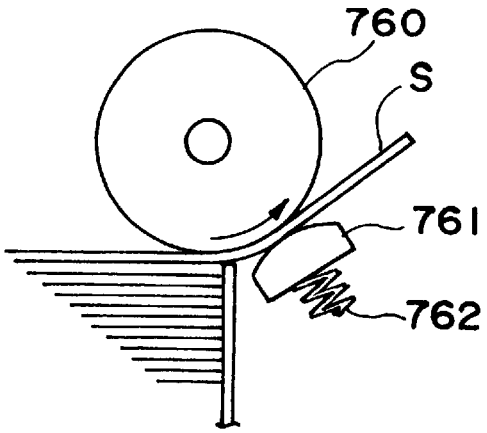
Figure 21C:
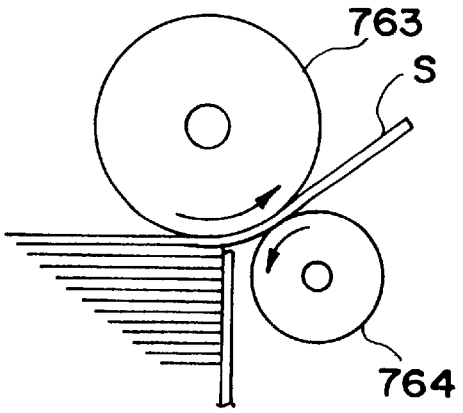
Figure 21D:
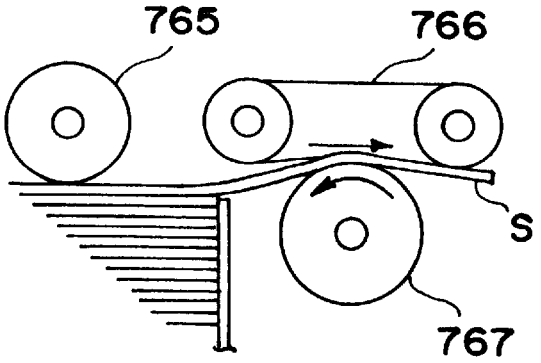
Figure 21E:
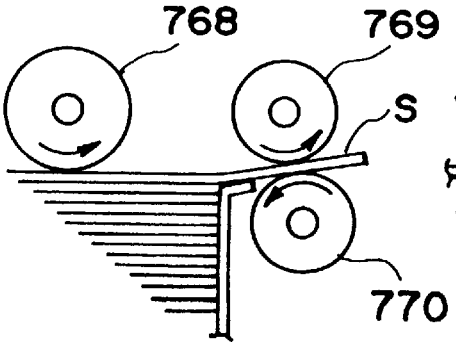
Figure 21F:
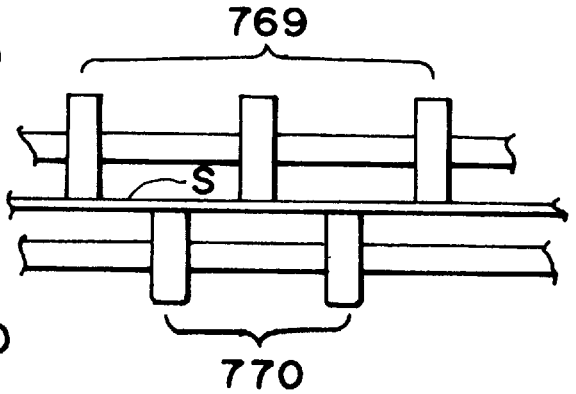

FIGS. 20(*a*), 20(*b*), and 20(*c*) show the positional relationship between sheet size and the moving members of the aligning fences 746 and 747, in the aligning range.

In FIGS. 20(*a*), 20(*b*), and 20(*c*) show, reference numerals 746 and 747 designate aligning fences, respectively (the same as they are in FIG. 15). Referential figures Sn, Sm, Sk, (Sn+1), (Sm+1), and (Sk+1) designate a sheet, and a referential figure TN designates the distance from the sheet (Sn+1), (Sm+1), or (Sk+1) to the moving members of the aligning fences 746 and 747. Referential FIGS. ΔTN, ΔTS, and ΔTL designates a sheet interval, and a referential figure T1 designates the distance from the leading edge of the sheet Sn, Sm, or Sk to the leading edge of the sheet (Sn+1), (Sm+1), or (Sk+1), correspondingly.

In the preceding description of the sheet aligning control in this embodiment, a case in which the sheet interval between the sheet Sn having arrived at the aligning position and the following sheet (Sn+1) equals the distance ΔT between the moving member of the aligning fences 746 and 747 and the sheet (Sn+1) as illustrated in FIG. 20(*a*) was used as an example. However, when the width of the sheet Sm is less than the width of the sheet Sn as illustrated in FIG. 20(*b*), the distance between the following sheet (Sm+1) and the moving members of the aligning fences 746 and 747 is shorter and the distance TS between the sheet Sm having arrived at the aligning position and the following sheet (Sm+1).

In such a case, the CPU 860 obtains the amount of sheet size difference from the sheet size detecting means of the sheet feeder cassette, and subtracts this amount of sheet size difference from the amount of the sheet interval detected by the sheet detecting sensor (amount of the sheet size difference is convered into amount of time based on the speed of the discharge roller). Then, based on the result of this subtraction, the CPU 860 determines whether or not the aligning fences 746 and 747 should be moved.

Next, referring to FIG. 20(*c*), when the width of the sheet Sk is greater than the width of the sheet Sn, the distance between the sheet Sk having arrived at the aligning position and the moving members of the aligning fences 746 and 747 is greater than the sheet interval ΔTL.

In such a case, the CPU 860 obtains the amount of sheet size difference from the sheet size detecting means of the sheet feeder cassette, and adds this amount of sheet size difference to the amount of the sheet interval detected by the sheet detecting sensor (amount of the sheet size difference is converted into amount of Lime based on the speed of the discharge roller). Then, based on the result of this addition, the CPU 860 determines whether or not the aligning fences 746 and 747 should be moved.

As described above, the sheet interval mentioned in this embodiment may be reworded as the minimum distance from the moving members of the aligning fences to an incoming sheet, at the time when the preceding sheet has arrived at the aligning position.

Therefore, the CPU 860 has only to be enabled to add or subtract the amount of sheet size difference from the sheet interval measured actually by the sheet detecting sensor, and use the result of the addition or subtraction to determine whether or not the aligning fences should be moved.

Further, the sheet feeding mechanism in this embodiment was described as a mechanism which employed a retarding system. However, the sheet feeding mechanism may be a mechanism different from the one described in this embodiment; it may be any mechanism as long as it is capable of preventing sheets from being fed together. For example, it may be of a type which relies on difference in frictional coefficient (frictional coefficient between feeding roller and sheet>frictional coefficient between friction causing member and sheet>frictional coefficient between two sheets). In other words, this embodiment does not limit the type of sheet feeding mechanism to which the present invention is applicable.

FIGS. 21(*a*), 21(*b*), 21(*c*), 21(*d*), 21(*e*), and 21(*f*) show various other frictional coefficient based mechanisms for preventing sheets from being fed together.

FIG. 21(*a*) illustrates a sheet separating system based on a claw; FIG. 21(*b*), a sheet separating system based on frictional difference; FIG. 21(*c*), a sheet separating system based on counter rotating rollers; FIG. 21(*d*), a sheet separating system based on a belt; FIG. 21(*e*), a sheet separating system based on counter rotating rollers; and FIG. 21(*f*) is a side view of the sheet separating system illustrated in FIG. 21(*e*), as seen from the right-hand side. A referential numeral 758 designates a feed roller; 769, a corner claw; 760, a feed roller; 761, a friction pad; 762, a compression type spring for the friction pad; 763, a feed roller; 764, a friction roller; 765, a pickup roller; 766, a feed belt; 767, a friction roller; 768, a pickup roller; 769, a feed roller; 770, a friction roller; a referential figure S designates a sheet. All the sheet separating mechanisms illustrated in FIG. 20 are of the type based on difference in frictional coefficient (frictional coefficient between feeding roller and sheet>frictional coefficient between friction causing member and sheet>frictional coefficient between two sheets).

EMBODIMENT 4

In this embodiment, a case in which the present invention is applied to a sheet sorting apparatus (sheet processing apparatus) will be described.

Figure 22:
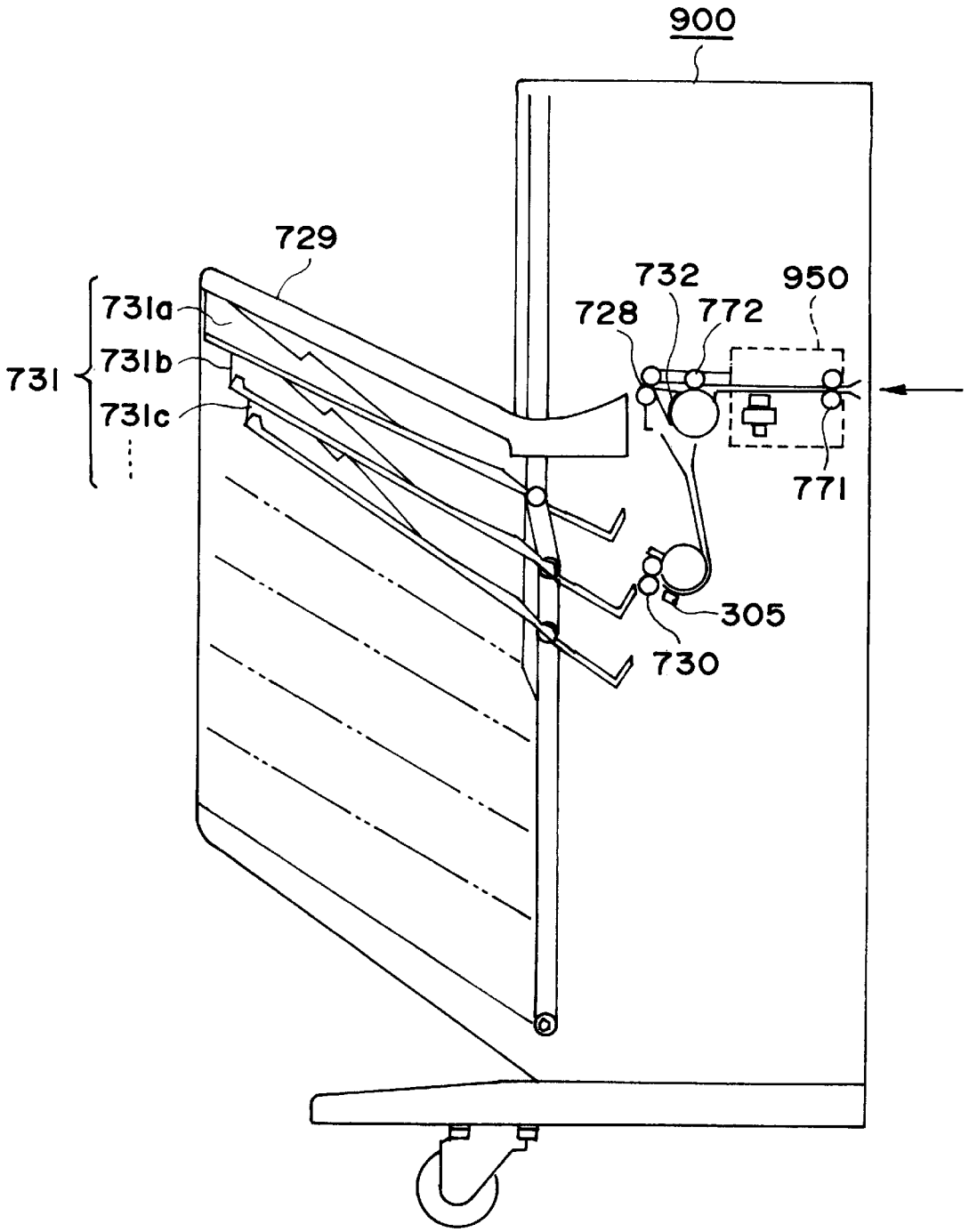
FIG. 22 is a vertical section of a sheet processing apparatus employing the sheet storing apparatus in the fourth embodiment of the present invention, parallel to the front panel of the apparatus.
Figure 23:
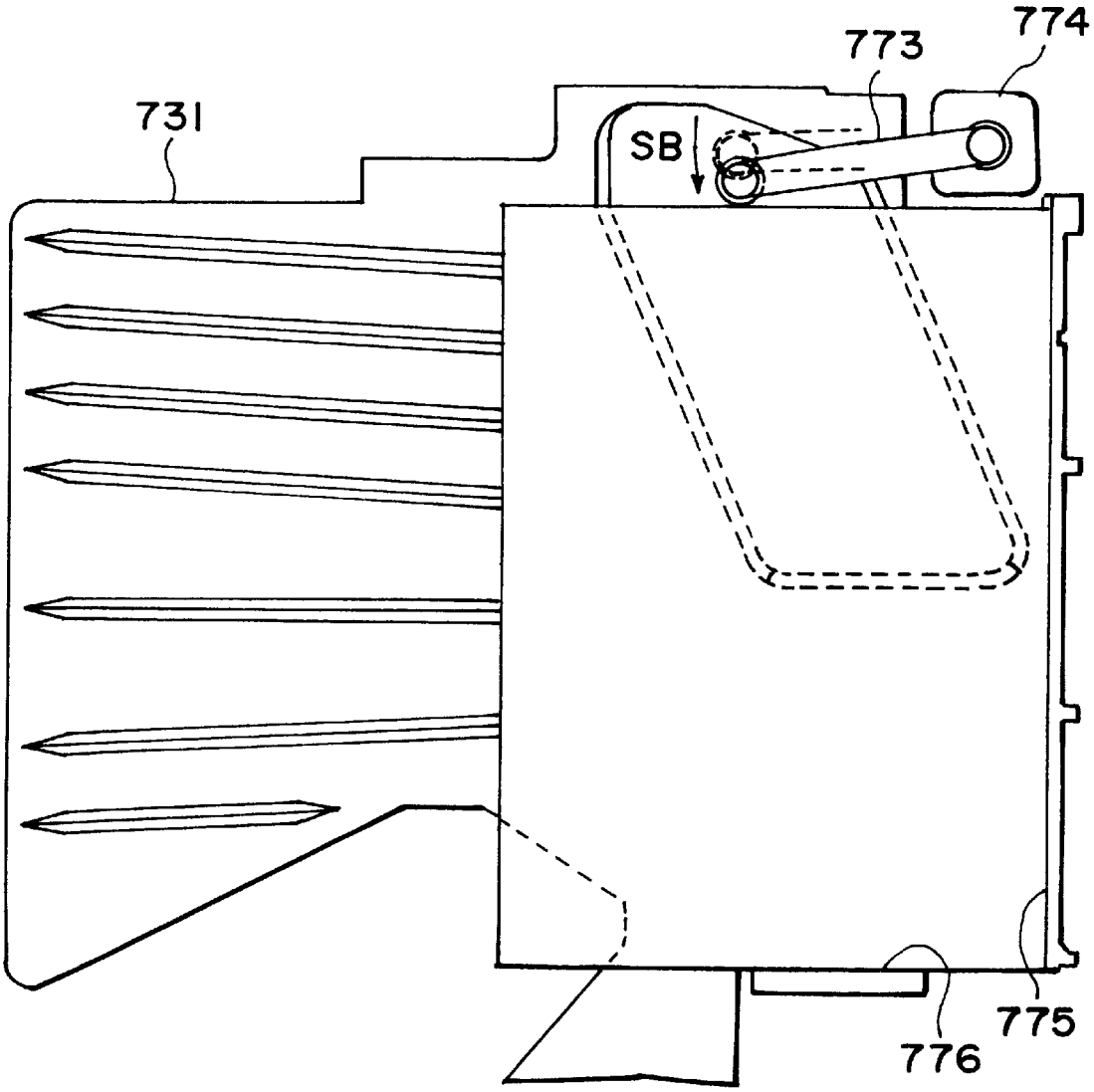
FIG. 23 is a plan of the sorting tray of the same.
Figure 24:
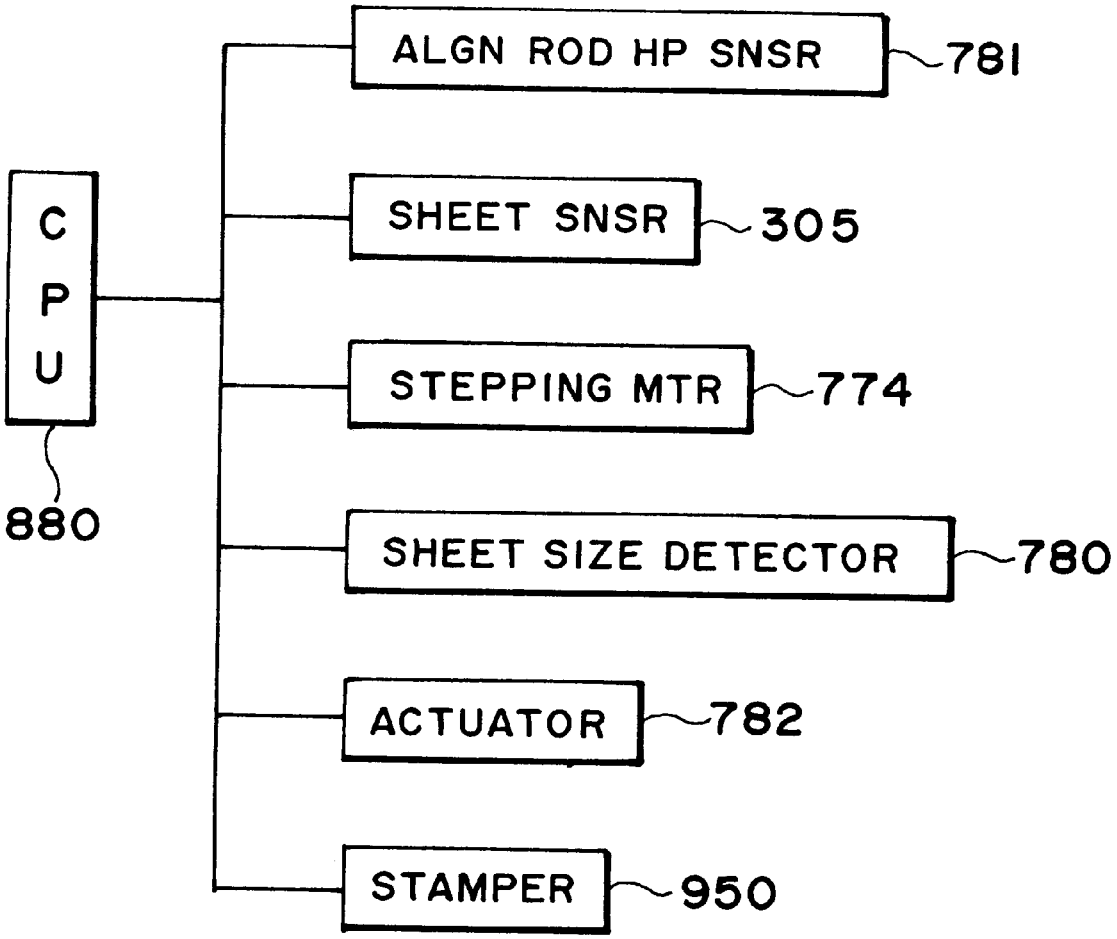
FIG. 24 is a schematic block diagram for the control for the sheet storing apparatus of the same.

FIG. 22 is a vertical section of a sheet sorting apparatus 900; FIG. 23, a plan of a sorting tray section (storing means); and FIG. 24 is a block diagram for controlling the sheet sorting apparatus.

In FIG. 22, reference numeral 305 designates a sheet detecting sensor (sheet interval detecting means), and reference numerals 771 and 772 designate a conveyer roller. A reference numeral 950 designates a printing apparatus such as a stamping apparatus (other referential figures designate the same items as those in FIG. 13, and therefore, their description will be omitted). A sheet introduced into the sheet sorting apparatus 900 is stamped by a stamping apparatus 960. More specifically, when a stamping instruction is issued by the operational section of the sheet sorting apparatus 900, or the operational section of an image forming apparatus, a sheet conveying apparatus, or the like which are connected to the sheet sorting apparatus 900, the stampling apparatus 950 is activated by a CPU 880 (controlling means) to stamp the sheet.

The CPU 880 controls the conveyer roller 772 so that the sheet conveying speed of the conveyer roller 772 becomes slower (inclusive of stopping) when the printing apparatus 950 is activated than when the printing apparatus 950 is not activated, and then, the sheet conveying speed is restored after the stampning.

Therefore, the sheet inteval fluctuates also in this case, that is, depending on whether or not the printing apparatus 950 is activated. This sheet interval fluctuation is in addition to the sheet interval fluctuation described in the third embodiment, which occurs during the feeding of sheets, and the sheet interval fluctuation described also in the third embodiment, which occurs when sheets are refed after being inverted.

Next, a sheet aligning operation carried out in a sorting tray will be described.

Referring to FIG. 22, the sorting tray 731 of the sheet sorting apparatus 900 is tilted upward relative to the direction in which sheets are discharged. A sheet discharged into the sorting tray 731 slides down, with its bottom surface being guided by the sheet bearing surface of the sorting tray 731, or by the preceding sheet having been accumulated in the sorting tray 731), and as it comes in contact with a leading edge reference stopper 775 illustrated in FIG. 23, it is aligned in the sheet conveyance direction, at the trailing edge, relative to the sheet conveyance direction.

On the other hand, as for the sheet alignment at the lateral edge relative to the sheet conveyance direction, an aligning rod (aligning means) 773 is moved in the direction of an arrow mark (SB) by a stepping motor 774 after the sheet comes in contact with the leading edge reference stopper 775. As a result, the sheet is shifted toward a lateral reference wall (aligning means) 776, that is, a reference for the lateral edge of the sheet, and as it comes in contact with the lateral reference wall 776, it is aligned at the lateral edge against the lateral reference wall 776. In other words, the sheet is aligned at the lateral edge as the aligning rod 773 moved from a sheet receiving position outlined by a broken line in FIG. 23 to an aligning position outlined by a solid line also in FIG. 23.

The aligning rod 773 is controlled by a CPU 880. More specifically, the aligning rod 773 is initially set at its home position (position for accommodating a sheet of maximum size: position outlined by a broken line) based on the output from unillustrated home position sensor, and then is moved a predetermined distance correspondent to sheet size, to a sheet receiving position.

The operational timing and moving distance of the stepping motor 774 is also controlled by the CPU 880 so that the aligning operation is prohibited when the value of the output of the sheet detecting sensor 305 is less than a value equivalent to a predetermined sheet interval (time necessary for the aligning rod 773 to move, after a sheet comes in contact with the leading edge reference stopper 775, from the sheet receiving position to the aligning position, aligning thereby the sheet at the lateral edge, and return to the sheet receiving position).

More specifically, a predetermined number of incoming sheets are stored without activating the aligning rod 773. Then, after the sheet interval recovers enough to exceed the time necessary for sheet alignment, the aligning operation is restarted.

In this embodiment, the present invention was described with reference to a case in which the sheet sorting apparatus 900 was provided with the printing apparatus 95 such as a stamping apparatus, but the present invention is not limited by this embodiment. For example, the present invention is also applicable to a sheet sorting apparatus in which the printing apparatus is replaced with a hole punching apparatus or the like which punches filing holes. In this case, the present invention is applicable to control the sorting apparatus in which sheet interval fluctuation occurs because when the hole punching apparatus or the like is in operation, the sheet conveyance speed is slowed, and therefore, sheet interval is reduced relative to when it is not in operation.

The present invention is also applicable to a sheet sorting apparatus which is not provided with a printing apparatus or the like, since the sheet interval fluctuates due to various reasons. For example, conveyer rollers deteriorate with age or usage, and the deteriorated rollers slip against the sheets. This makes the sheet interval irregular. Differences in surface properties of each sheet varies the slippage between the sheet and rollers. This also causes the sheet interval to flucturate. Further, the slippage causes sheets to be fed with irregular intervals. This also makes the sheet interval irregular.

The positioning of the sheet detecting sensor 305 in this embodiment does not limit the application of the present invention.

While the invention has been described with reference to the structures disclosed herein, it is not confined to the details set forth, and this application is intended to cover such modifications or changes as may come within the purposes of the improvements or the scope of the following claims.

What is claimed is:

1. A sheet accommodating apparatus comprising:

sheet accommodating means for accommodating one-by-one sheets fed thereto;

means for feeding the sheets at intervals to said sheet accommodating means;

aligning means for aligning the sheets, said aligning means being disposed on said sheet accommodating means;

sheet interval detecting means for detecting at least one of an interval time and a distance between adjacent sheets; and control means for preventing said aligning means from operating when an output of said sheet interval detecting means indicates that at least one of the sheet interval time or the distance is shorter than a time required for said aligning means to align the sheets or a distance through which the sheets moves in the time required for said aligning means to align the sheets.

2. An apparatus according to claim 1, wherein said control means prevents the operation when a prior sheet of the accommodated sheets is received by said accommodating means.

3. An apparatus according to claim 1, wherein said sheet interval detecting means is an optical sensor which also functions as a jam detection sensor for detecting jam of the sheet received by said accommodating means.

4. An apparatus according to claim 1, wherein said sheet interval detecting means is disposed in a transportation path for the sheets, said apparatus further comprising detecting means for detecting passing of the sheet to control the operation of said aligning means.

5. An apparatus according to claim 1, 2, 3 or 4, further comprising a leading edge aligning means for being abutted by a distal end of the sheet fed to said accommodating means.

6. An apparatus according to claim 1, 2 or 3, further comprising timing detecting means for controlling operation timing of said aligning means.

7. An apparatus according to claim 6, wherein when an output of said sheet interval detecting means indicates that sheet interval time or distance is shorter than time required for said aligning means to align the sheets or the distance through which the sheets moves in the time required for said aligning means to align the sheets, said control means prevents, even upon detection of the sheet by said timing detecting means, operation of said aligning means when the sheet immediately before the detected sheet is received by said sheet accommodating means.

8. An apparatus according to claim 7, wherein when the sheet interval becomes longer than a predetermined time or distance after the prevention, said control means permits the aligning operation.

9. A sheet binding apparatus comprising the sheet accommodating apparatus as defined in claim 1, and a binding means for binding a set of the sheets.

10. A sheet binding apparatus, comprising:

sheet accommodating means for accommodating one-by-one sheets fed thereto;

means for feeding the sheets at intervals to said sheet accommodating means;

aligning means for aligning the sheets, said aligning means being disposed on said sheet accommodating means;

sheet interval detecting means for detecting at least one of an interval time and a distance between adjacent sheets;

first control means for preventing said aligning means from operating when an output of said sheet interval detecting means indicates that the sheet interval time or the distance is shorter than a time required for said aligning means to align the sheets or a distance through which the sheet moves in the time required for said aligning means to align the sheets;

inserting means for permitting insertion of a sheet between sets of sheets fed to said sheet accommodating means;

inserted sheet detecting means for detecting an inserted sheet supplied by said inserting means; and second control means for preventing said aligning means from operating when the inserted sheet detected by said inserted sheet detecting means and the sheet immediately therebefore is received by said sheet accommodating means.

11. A sheet accommodating apparatus according to claim 1, further comprising:

refeeding means for refeeding the sheets accommodated in said sheet accommodating means.

12. A sheet accommodating apparatus according to claim 11, wherein the alignment operation of said aligning means is resumed, when the sheet interval time or the distance becomes, after the alignment prevention, longer than the time required for said aligning means to align the sheets or the distance through which the sheets moves in the time required for said aligning means to align the sheets.

13. A sheet accommodating apparatus according to claim 11, further comprising a sheet size recognition means for recognizing a size of the sheet fed to said sheet accommodating means, and a discrimination is made whether to operate said aligning means on the basis of a size difference between a prior sheet and a next sheet recognized by said sheet size recognition means and of a result of detection of said sheet interval detecting means.

14. An image forming apparatus comprising:

sheet accommodating means for accommodating one-by-one sheets fed thereto;

means for feeding the sheets at intervals to said sheet accommodating means;

aligning means for aligning the sheets, said aligning means being disposed on said sheet accommodating means;

sheet interval detecting means for detecting at least one of an interval time and a distance between adjacent sheets;

control means for preventing said aligning means from operating when an output of said sheet interval detecting means indicates that the sheet interval time or the distance is shorter than a time required for said aligning means to align the sheets or a distance through which the sheet moves in the time required for said aligning means to align the sheets;

refeeding means for refeeding the sheets accommodated in said sheet accommodating means; and image forming means for forming an image on a sheet fed to said sheet accommodating means.

15. A sheet accommodating apparatus according to claim 1, further comprising:

a plurality of said sheet accommodating means, which sort and accommodate sheets discharged by sheet discharging means.

16. A sheet accommodating apparatus according to claim 15, wherein the alignment operation of said aligning means is resumed, when the sheet interval time or the distance becomes, after the alignment prevention, longer than the time required for said sheet aligning means to align the sheets or the distance through which the sheets moves in the time required for said sheet aligning means to align the sheets.

17. An image forming apparatus comprising:

sheet accommodating means for accommodating one-by-one sheets fed thereto;

means for feeding the sheets at intervals to said sheet accommodating means; aligning means for aligning the sheets, said aligning means being disposed on said sheet accommodating means;

sheet interval detecting means for detecting at least one of an interval time and a distance between adjacent sheets;

control means for preventing said aligning means from operating when an output of said sheet interval detecting means indicates that the sheet interval time or the distance is shorter than a time required for said aligning means to align the sheets or a distance through which the sheets moves in the time required for said aligning means to align the sheets;

a plurality of said sheet accommodating means, which sort and accommodate sheets discharged by sheet discharging means; and an image forming means for forming a images on the sheets fed thereto, and discharging means for discharging the sheets having the image formed by said images forming means to said sorting apparatus.

* * * * *

UNITED STATES PATENT AND TRADEMARK OFFICE

CERTIFICATE OF CORRECTION

PATENT NO. : 5,938,192

DATED : August 17, 1999

INVENTOR(S) : HIDEAKI KOSASA

It is certified that error appears in the above-identified patent and that said Letters Patent is hereby corrected as shown below:

COLUMN 12,
Line 5, cassette 717: should read --casette 717;--;
Line 6, "together:" should read --together;--; and
Line 45, "above" should read --above- --.

COLUMN 13,
Line 6, "a" (second occurrence) should be deleted;
Line 9, "is" (second occurrence) should be deleted;
Line 23, "pulley:" should read --pulley;--;
Line 33, "aligning" should read --align--; and
Line 47, "852)" should read --852--.

UNITED STATES PATENT AND TRADEMARK OFFICE

CERTIFICATE OF CORRECTION

PATENT NO. : 5,938,192

DATED : August 17, 1999

INVENTOR(S) : HIDEAKI KOSASA

It is certified that error appears in the above-identified patent and that said Letters Patent is hereby corrected as shown below:

COLUMN 15,
Line 36, "In" should be deleted.
Line 64, "convered" should be --converted--.

COLUMN 16,
Line 10, "Lime" should be --time--.

COLUMN 17,
Line 19, "inteval" should read --interval--.

COLUMN 18,
Line 26, "flucturate" should be --fluctuate--.

Signed and Sealed this

Twenty-third Day of May, 2000

*Attest:*

Q. TODD DICKINSON

*Attesting Officer*

*Director of Patents and Trademarks*